US006528220B2

(12) United States Patent
Yoshida et al.

(10) Patent No.: US 6,528,220 B2
(45) **Date of Patent: *Mar. 4, 2003**

(54) ELECTROPHOTOGAPHIC COLOR TONER, ELECTROPHOTOGRAPHIC DEVELOPER, AND IMAGE-FORMING PROCESS

(75) Inventors: Satoshi Yoshida, Minamiashigara (JP); Masaki Nakamura, Minamiashigara (JP); Shin Yasuda, Minamiashigara (JP); Koichi Takashima, Minamiashigara (JP); Daisuke Ishizuka, Minamiashigara (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/414,420

(22) Filed: Oct. 8, 1999

(65) Prior Publication Data

US 2002/0081509 A1 Jun. 27, 2002

(30) Foreign Application Priority Data

Oct. 12, 1998 (JP) ..... 10-289835
Jan. 19, 1999 (JP) ..... 11-011032

(51) Int. Cl.[7] ..... G03G 9/097

(52) U.S. Cl. ..... 430/108.1; 430/108.6; 430/108.7; 430/110.1; 430/11.4; 430/124; 430/126

(58) Field of Search ..... 430/110, 111, 430/108.1, 108.6, 108.7, 108.4, 108.11, 108.22, 110.4, 111.4, 110.1, 124, 126

(56) References Cited

U.S. PATENT DOCUMENTS 4,740,443 A * 4/1988 Nakahara et al. ..... 430/108.8
5,338,597 A * 8/1994 Kurabayashi et al. ..... 428/195
5,688,625 A * 11/1997 Bertrand ..... 430/110
5,714,294 A * 2/1998 Maruta et al. ..... 430/110

FOREIGN PATENT DOCUMENTS

EP 0628883 A1 * 12/1994
JP 42-23910 11/1967
JP A-6-332247 12/1994
JP A-8-220800 8/1996

* cited by examiner

*Primary Examiner*—Janis L. Dote
(74) *Attorney, Agent, or Firm*—Oliff & Berridge, PLC

(57) ABSTRACT

An electrophotographic color toner containing at least a coloring agent, a binder resin, and light-color or colorless fine particles, wherein toner particles containing particles having particle sizes of at least 1.0 $\mu$m as said fine particles are not more than half of the total toner particles. The electrophotographic color toner has a broad fixable temperature region of the toner and does not cause an image deterioration by preventing the occurrence of the penetration phenomenon into a paper while keeping a high image quality and high coloring even by using paper other than a paper for color copy without deteriorating various characteristics of a toner of prior art.

9 Claims, 4 Drawing Sheets

ELECTROPHOTOGAPHIC COLOR TONER, ELECTROPHOTOGRAPHIC DEVELOPER, AND IMAGE-FORMING PROCESS

FIELD OF THE INVENTION

The present invention relates to an electrophotographic color toner (hereinafter, is sometimes referred to as simply "toner") used for instruments utilizing an electrophotographic process, such as a copying machine, a printer, a facsimile, etc., and particularly, for a color copying machine; an electrophotographic developer; and an image-forming process.

BACKGROUND OF THE INVENTION

As an electrophotographic process, various processes, from the processes described in Japanese Patent Publication No. 42-23910 (1967), etc., have hitherto been known. In an electrophotographic process, an electrostatic latent image is electrically formed on a photoreceptor utilizing a photoconductive substance by various means, the latent image is developed using a toner, after transferring the toner image on the photoreceptor onto a transfer material such as a paper, etc., using or without using an intermediate transfer material, the transferred image is fixed by heating, pressing, heat-pressing, a solvent vapor, etc., to form a fixed image through the above-described plural steps. The toner remained on the photoreceptor is, if necessary, cleaned by various methods, and the above-described plural steps are repeated.

Recently, with the development of instruments in an information-oriented society and the repletion of a communication network system, such an electrophotographic process has been widely used not only for copying machines but also printers and also a color-image formation by an electrophotographic process has been rapidly advanced. With the propagation of color copying machine and printer (hereinafter, a copying machine and a printer are generally referred to as "copying machine" in this invention), a black and white copying machine is being unable to be distinguished from a color copying machine, and the using way of forming both a black and white copy or print and a color copy or print by a same color copying machine has been increased.

In the case of, as a matter of course, black and white images and, particularly, in the case of color images, it has been strongly required that the images formed have a high image quality and a high coloring. In order to obtain an image of a high image quality and a high coloring, from the view points of a light transmittance, a glossiness, etc., it is required that a toner is sufficiently melted and the surface of the image after fixing is smooth. For the reason, as a toner for a color electrophotography of prior art, a resin which has a low molecular weight and is relatively sharply melted from a glassy state to lover the melting viscosity is used, and as a fixing step, a contact-type heat-press fixing system excellent in the thermal efficiency, the reliability, and the safety has been used.

However, because the toner using a such a resin is sharply melted, the melting viscosity thereof is changed susceptibly to the temperature change at fixing. Also, because the melting viscosity at fixing must be lowered, the toner has a fault that the permeation of the toner among the fibers of a paper mainly used for image recording occurs (hereinafter, is referred to as "penetration phenomenon") and the image formed is deteriorated. Accordingly, to obtain an image having a high image quality in a color copying machine of prior art, it is required to use a specific paper for color copying, which has a coating layer or has a relatively dense space between the fibers to be able to reduce the penetration phenomenon.

However, when it becomes possible to form both a black and white copy and a color copy by a same color copying machine as described above, it has been desired to be able to use a paper which has hitherto been used for a black and white copying machine (hereinafter, is referred to as "plain paper") for the color copy. Because a plain paper has a small heat capacity of the paper itself as compared with a paper for color copying, the amount of heat added to a toner at fixing is increased, which rends to lower the melting viscosity of the toner than the melting viscosity at fixing in a paper for color. Further, there newly occurs the problem that because the space between the fibers of the plain paper is rough (not dense), the penetration phenomenon of a toner remarkably occurs to deteriorate the image formed. When the penetration phenomenon occurs, because the diameter of the fibers used for a plain paper is several tens m and the diameter of about the size of the space between the fibers, the image deterioration is sufficiently visually detected as the irregularity of image. About the deterioration of image by the penetration phenomenon, considering from that even in, for example, a printing technique and an ink jet technique, oozing of a printing ink or an ink for ink jet is prevented by using a specific paper having formed an image-receiving layer, such as a coated paper, a silica-coated paper, etc., it is sure that the solution is difficult. However, it is important to utilize the excellent convenience of the plain paper aptitude of a black and white copying machine and to provide a high image-quality technique without need of selection of paper in color copying.

Moreover, for the further requirement of forming images of a higher image quality, there is an attempt of thinning the image thickness of a fixed image. The image thickness of an electrophotographic image of prior art in from 5 to 7 $\mu$m per one color and in the case of a full color, the image thickness reaches 20 $\mu$m, whereby the difference in image thicknesses between a dense portion of an image density and a thin portion of an image density gives a sense of incongruity to observing persons. On the other hand, the image thickness of a printed image, which is a typical image having a high image quality, is few $\mu$m even in full color and the printed image does not give a sense of incongruity as described above. Thus, in an electrophotographic image, it has been attempted to reduce the particle sizes of a toner to obtain a high resolving power, whereby a high-quality image similar to the printed image is obtained. However, to the printed image using a coated paper, in the case of an electrophotographic image using a paper having greatly lower surface smoothness than that of the coated paper, which the image thickness becomes thin, the above-described image deterioration becomes more liable to occur. Because the image deterioration described above is seen as white spots in the image and particularly when a wide area is occupied by a same density, a very unpleasant feeling is given, the improvement has been strongly desired.

A method of directly preventing the occurrence of such a penetration phenomenon of toner has not yet been proposed but many techniques having similar effects have been proposed.

For the purpose of realizing both low-temperature fixing and an offset resistance by incorporating fine particles in a toner to reduce the changing ratio of the melting viscosity of the toner to a temperature, Japanese Patent Laid-Open No.

6-332247 (1994) discloses a resin for toner wherein a polyester resin having a number average molecular weight of from 1000 to 5000 and an acid value of from 10 to 50 mg KOH/g is used as matrix and crosslinked resin particles having a mean particle size of from 0.05 to 2.0 $\mu$m is used the domain. By the method, the melting viscosity curve is surely improved but when particles having a large mean particle size are incorporated, the occurrence of the penetration phenomenon of the toner cannot be prevented as well as the glossiness of the image is not obtained and the coloring property is lowered. Also, in the above-described patent publication, there are no descriptions about the dispersibility of the particles and when the dispersibility is inferior, the occurrence of the penetration phenomenon cannot be prevented. Furthermore, because for mixing the particles and the binder, a solvent is used, it cannot be avoided that the particles, which are a resin, are dissolved or swelled. Thereby, the particles are aggregated or it is necessary to dry the particles at a high temperature to remove the solvent in the particles, whereby it sometimes happens that the particles are aggregated in the drying step and the heat deterioration of the resin by temperature occurs. When the particles are aggregated, there occur the problems that it becomes difficult to prevent the occurrence of the penetration phenomenon and the heat deterioration reduces the toner characteristics such as the electrostatic charging property, etc.

Also, Japanese Patent Laid-open No. 8-220800 (1996) discloses a toner wherein inorganic particles are incorporated in toner binders and the viscoelastic characteristics of each color are made same as those of a black toner to improve the offset resistance. By the method, the melting viscoelastic curve of the toner can be surely improved in the measurement of the viscoelasticity data, but in a high-speed copying machine requiring a high speed, a high image quality, and high coloring, the effect is scarcely obtained for the offset resistance. This is because the state of the toner during the measurement of the viscoelasticity is utterly different from the state of the toner during fixing. Also, when the dispersibility of these particles is inferior, the occurrence of the penetration phenomenon cannot be prevented. Moreover, when the addition amount of the inorganic particles is from 1 to 10 parts by weight, the prevention of the occurrence of the penetration phenomenon occurring from a higher viscosity than a hot offset is insufficient.

As described above, it is difficult to prevent the occurrence of the penetration phenomenon of a toner into a plain paper by using the above-described techniques of prior art, and a toner newly designed has become necessary at present.

SUMMARY OF THE INVENTION

The present invention has been made in view of the above-described problems in the techniques of prior art and an object of this invention is to provide an electrophotographic color toner which has a broad fixable temperature region of the toner and does not cause an image deterioration by preventing the occurrence of the penetration phenomenon to a paper while keeping a high image quality and high coloring even by using paper other than a paper for color copy without deteriorating various characteristics of a toner of prior art, and also to provide an electrophotographic developer using the toner and an image-forming process using the developer.

As the result of various investigations by paying a specific attention to not only the melting viscoelasticity of a toner but also a fixing member (a transfer material), particularly the characteristics of a paper, such as the unevenness of the fibers of a paper and the surface characteristics of a paper, the present inventors have discovered that by incorporating fine particles in a toner in a specific state, an image having a high image quality and high coloring can be maintained and also the occurrence of the penetration phenomenon of a toner into a paper can be restrained and have accomplished the present invention.

That is, the first aspect of this invention is an electrophotographic color toner containing at least a coloring agent, a binder resin, and light color or colorless fine particles, wherein the toner particles containing fine particles having particle sizes of at least 1.0 $\mu$m as said fine particles do not constitute more than half of the total toner particles.

The second aspect of this invention is an electrophotographic color toner containing at least a coloring agent and a binder resin, wherein the dynamic complex elastic modulus G*(distortion ratio 100%, frequency 10 rad/sec.) of the toner measured at a temperature at which the dynamic complex elastic modulus $G^{*1}$ (distortion ratio 100%, frequency 10 rad/sec.) of said binder resin becomes 1000 Pa is from 3000 to 50000 Pa.

The third aspect of this invention is an electrophotographic developer containing at least a toner, wherein said toner is the electrophotographic color toner described in the above-described first or second aspect The fourth aspect of this invention is an image-forming process including a step of forming an electrostatic latent image on a latent image support, a step of developing the latent image using an electrophotographic developer to form a toner image, a step of transferring the developed toner image onto a transfer material, and a step of fixing the toner image on the transfer material, wherein said electrophotographic developer is the electrophotographic developer described in the above-described third aspect, and the surface smoothness of the transfer material is 80 seconds or lower.

The fifth aspect of this invention is an image-forming process including a step of forming an electrostatic latent image on an electrostatic latent image support, a step of forming a toner image by developing the electrostatic latent image using an electrophotographic developer, a step of transferring the developed toner image onto a transfer material, and a step of fixing the toner image on the transfer material, wherein said electrophotographic developer is the electrophotographic developer described in the above-described third aspect, and the step of fixing the toner image on the transfer material is carried out using a heat-contact-type fixing apparatus.

DETAILED DESCRIPTION OF THE INVENTION

Figure 1:
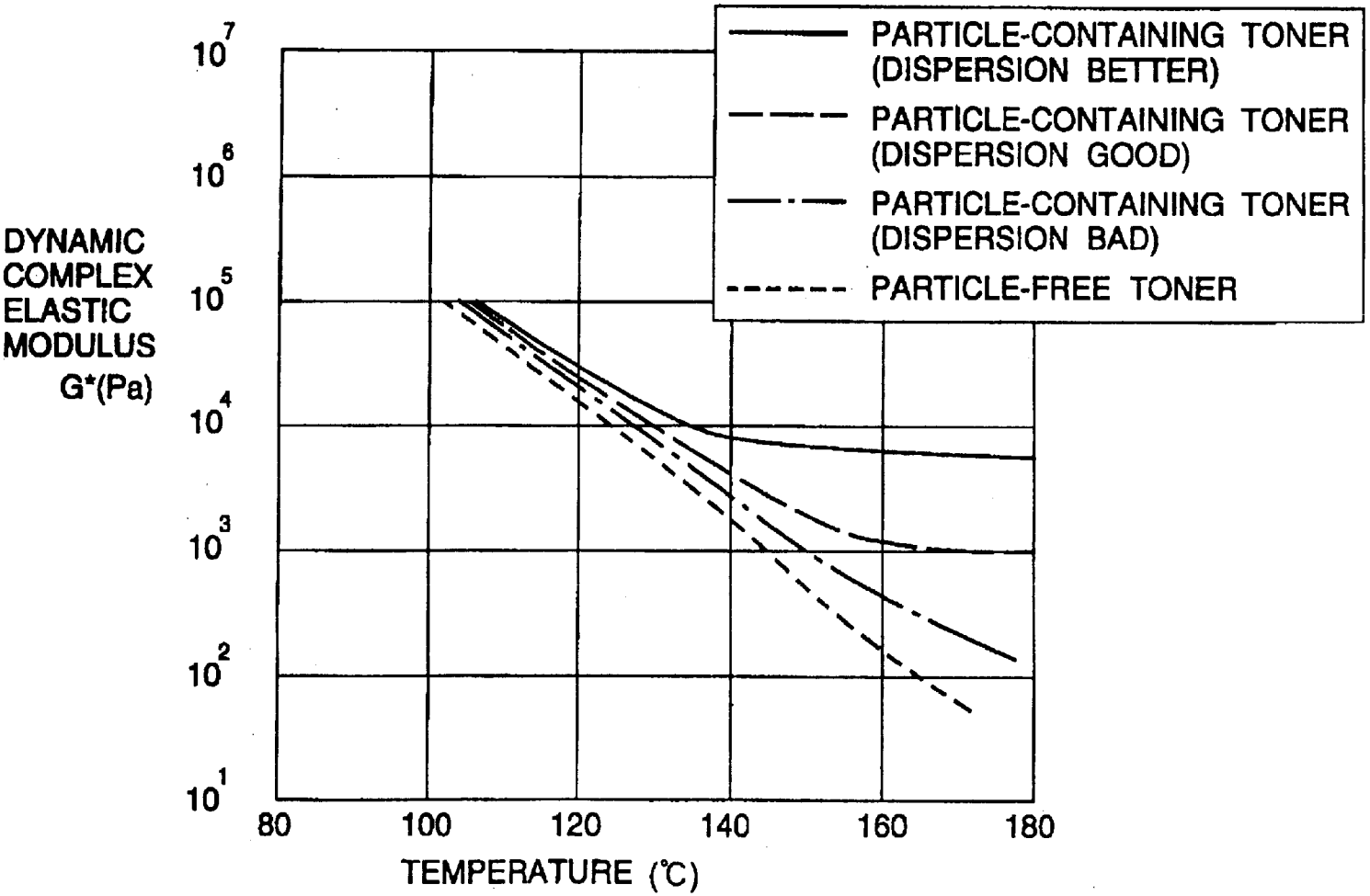
FIG. 1 is a view showing the relation of the dynamic complex elastic modulus G* of a toner and a temperature.

The present invention is described in detail below.

The electrophotographic color toner of this invention is an electrophotographic color toner containing at least a coloring agent, a binder resin, and light color or colorless fine particles (hereinafter, are referred to as simply "fine particles"), wherein toner particles containing particles having particle sizes of at least 1.0 μm as said fine particles are not more than half of the total toner particles.

The above-described term "toner particles containing particles having particle sizes of at least 1.0 μm as said fine particles are not more than half" shows that the existence of primary particles wherein the particle sizes of the fine particles are 1.0 μm or larger is less and the existence of secondary particles (hereinafter, are sometimes referred to as aggregates) having particle sizes of 1.0 μm or larger formed by the aggregation of the primary particles having a mean particle size of less than 1.0 μm is less in the total toner particles. Usually, because when fine particles are incorporated in a toner, aggregates are formed, if toner particles containing particles having particle sizes of at least 1.0 μm as said fine particles are not more than half, it can be said that the fine particles are uniformly dispersed.

The above-described "toner particles containing particles having particle sizes of at least 1.0 μm as the fine particles are not more than half" is calculated as follows. That is, the toner is observed by a transmission-type electron microscope (TEM) or a scanning type electron microscope (SEM), one toner particle sampled at random is photographed at 30,000 magnifications, the operation is carried out 50 times, that is, the operation is carried out to 50 toner particles, and from 50 photographs obtained the number of the toner particles containing the particles of the largest size of 1.0 μm or larger as the fine particles is counted.

By uniformly dispersing the above-described fine particles in the toner, the melt fluid characteristics of the toner penetrating in the spaces of the fibers of a paper can be improved. The reason has not yet be clarified but is conjectured as follows.

Depending on the kind of paper, there is a distribution in the sizes of the spaces of the fibers of a paper and the spaces have pore sizes of from about 0.1 to 10 μm. In these spaces, those having the sizes of several μm or larger may be considered to be rather the unevenness of the surface of the paper than spaces and the spaces causing the penetration phenomenon are mainly considered to be the spaces having the sizes of not larger than 1 μm. A toner is smashed by the heat and the pressure at fixing and flows through the spaces and when the toner does not contain the fine particles, the toner is easily stuffed into the inner part. On the other hand, when the toner contains the fine particles, the flowing of the toner is hindered with the fine particles as resisting points and the penetration of the toner is prevented. In general, in a rheology, it is known that when a high-viscosity medium such as a toner further containing additives flows through such a capillary, a large disturbance occurs in the flow and it is conjectured that in the penetration of a toner into a paper, the same phenomenon occurs and the penetration of the toner is prevented. That is, in the case of considering that a toner flows through the inside of a capillary, it is considered to be suitable that the plural fine particles exist at the section of the capillary.

By the reason described above, it is necessary that the above-described fine particles are uniformly dispersed in the toner. However, when the number of the toner particles containing the particles having particle sizes of at least 1.0 μm as the fine particles exceeds half of the total toner particles, in the case of flowing the toner through the above-described capillary, a state that the toner component containing no fine particles flows occurs, not only the effect of preventing the penetration is not obtained, but also the gloss of the image after fixing is hard to increase, whereby the sharpness of the image is spoiled.

When the dispersibility of the above-described fine particles is poor, in the case of considering that the toner flows through a capillary as described above, the state that the toner component containing no fine particles flows occurs and the effect of preventing the penetration is not obtained. Furthermore, the aggregates of the fine particles reduce the smoothness of the image formed and hinder coloring. As the existence of the particles having the particle sizes of at least 1.0 μm is less in the toner, the effect of preventing the occurrence of the penetration phenomenon is higher. That is, the toner particles containing the particles having the particle sizes of at least 1.0 μm as the above-described fine particles is preferably not more than 2/5, and more preferably not more than 3/10 of the total toner particles.

Considering the toner flows through a capillary as mentioned above, the average primary particle size of the above-described fine particles is preferably from 1 to 500 nm from the view point that it is suitable that plural fine particles exist at the section of the capillary. The upper limit of the average primary particle size is more preferably not larger than 300 nm, and far more preferably not larger than 200 nm. If the average primary particle size exceeds 500 nm, there is a possibility that the prevention effect of the penetration becomes weak as well as the gloss of the image after fixing is hard to increase and the sharpness of the image formed is spoiled. Also, there is a tendency that as the average primary particle size of the fine particles is less, the effect of preventing the occurrence of the penetration phenomenon becomes higher but from the view points of the productivity of the particles, the handing property of them, etc., the lower limit of the average primary particle size is preferably 5 nm or larger.

Because in the volume fraction Φ of the above-described fine particles, the effective range differs according to the mean particle size, the volume fraction Φ is suitably shown by following formula (1), preferably by following formula (1-a), and more preferably by following formula (1-b);

$$0.015D^{0.4}<\Phi<0.5 \quad (1)$$

$$0.02D^{0.4}<\Phi<0.4 \quad (1\text{-a})$$

$$0.022D^{0.4}<\Phi<0.4 \quad (1\text{-b})$$

(in formulae (1), (1-a), and (1-b), D is a mean particle size of the primary particles.)

If in the formula (1), the volume fraction Φ is $0.015D^{0.4}$ or lower, the effect of the penetration prevention becomes hard to obtain, while if it is higher than 0.5, there is a possibility that raising of the fixing temperature and lowering of the fixing property occur. In general, there is a relation between the mean particle size and the content and as the mean particle size is smaller, the effect is obtained even when the content is less. That is, in view of the qualities of the binder resin and the fine particles, it is suitable that the volume fraction Φ is properly determined in the above-described range so that the toner characteristics other than the fixing property are not reduced.

By uniformly dispersing the above-described fine particles in the toner, the melting characteristics of the toner and the solid properties thereof can be changed, and the features thereof are described below.

By incorporating the above-described fine particles in the toner with a good dispersibility, the temperature reliance of the viscoelasticity of the toner (lowering of the dynamic complex elastic modulus of the toner) becomes moderate to a temperature change, it is hard to lower to the dynamic complex elastic modulus of 3000 Pa of to extent of initiating the penetration of the toner, and in the case of the dynamic complex elastic modulus of about 10,000 Pa to an extent of initiating fixing, the toner is viscous and can be easily smashed, coloring and fixing are easy, and the toner is suitable for the formation of a color image. On the other hand, when the toner does not contain the fine particles and it is attempted to obtain the temperature change of the viscoelasticity to the same extent as above by increasing the molecular weight of the resin, the molecular weight of the resin becomes about one figure larger, tan δ becomes too small, and the dynamic elastic modulus is too increased, and coloring and fixing become not easy. The relation of the temperature change of the viscoelasticity and the viscoelasticity is almost definitely determined by only the moderating course of the polymer chain in the case of a resin only, but because in the case of the resin containing the fine particles, the moderating course of the fine particle-dispersed resin can be changed by the kind, the content, and the dispersion of the particles, even by the temperature change of the viscoelasticity to the same extent, the viscoelasticity can be independently controlled from a viscous state to an elastic state, and both the prevention of the penetration phenomenon and coloring, fixing are possible. From this meaning, for applying the toner containing the fine particles to a color toner, the viscoelastic characteristics are very important. Also, in a solid state from normal temperature to about the glass transition temperature, even powder toners have the effect of restraining the occurrence of a heat blocking phenomenon of the fixed image and a paper and the fixed images of each other.

For attaining the penetration preventing effect, in the view point that the plural fine particles exist at the section of the capillary is suitable in the case of considering that the toner flows through a capillary as described above, and in the view point of the pure rheological properties of the toner, it is suitable that the toner of this invention satisfies the following viscoelastic condition (1). For satisfying the following viscoelastic condition (1), it is suitable that the above-described fine particles are incorporated in the toner in the above-described dispersed state.

Viscoelastic condition (1): The dynamic complex elastic modulus G*(distortion ratio 100%, frequency 10 rad/sec.) of the toner measured at a temperature at which the dynamic complex elastic modulus $G^{*1}$ (distortion ratio 100%, frequency 10 rad/sec.) of said binder resin becomes 1000 Pa is from 3000 to 50,000 Pa, and preferably from 5000 to 20,000 Pa.

The viscoelastic condition (1) is the index for showing that at the preparation of an unfixed image, the toner fell in the fibers of a paper can be kept to what extent of height of the elastic modulus of the viscoelasticity capable of preventing the penetration of the toner at fixing. As the dynamic complex elastic modulus G*of the toner is higher, the occurrence of the penetration phenomenon of the toner can be more prevented, but if it exceeds 50,000 Pa, the toner does not attach to a paper and if it is less than 3000 Pa, a penetration phenomenon of the toner occurs.

FIG. 1 is a view showing the relation of the dynamic complex elastic modulus G* and a temperature. From FIG. 1, it can be seen that in the toner satisfying the viscoelastic condition (1), the temperature reliance of the viscoelasticity (lowering of the dynamic elastic modulus of the toner) is moderate to the temperature change, it does not lower to the dynamic complex elastic modulus of 3000 Pa of to extent of initiating the penetration of the toner, and in the case of the dynamic complex elastic modulus of about 10,000 Pa to an extent of initiating fixing, the toner is viscous and can be easily smashed, coloring and fixing are easy, and the toner is suitable for the formation of a color image.

It is suitable that the toner of this invention satisfied the following viscoelastic condition (2). For satisfying the following viscoelastic condition (2), it is suitable that the above-described fine particles are incorporated in the toner in the above-described dispersed state.

Viscoelastic condition (2): The frequency dependency of the dynamic complex elastic modulus G*(distortion ratio 10%) of the above-described toner measured at a temperature at which the dynamic complex elastic modulus $G^{*1}$ (distortion ratio 100%, frequency 10 rad/sec.) of said binder resin becomes 1000 Pa is shown by following formula (2);

$$G^*(100\ \text{rad/sec.})/G^*(1\ \text{rad/sec.})<10 \quad (2)$$

The viscoelastic condition (2) is an index for showing that a moderation course of the viscoelasticity by the dispersion of the fine particles exists and the elastic modulus is effective in what extent of the temperature range. Consequently, the viscoelastic condition (2) shows that the frequency dependency of the viscoelasticity is less and that a specific moderation course of the viscoelasticity exists. When the moderation course of the viscoelasticity is insufficient or there scarcely exists the moderation course of the viscoelasticity, such as a toner containing no fine particles or a toner wherein the dispersibility of the fine particles is inferior, the frequency dependency and the temperature reliance of the viscoelasticity become large. When the value of G*(100 rad/sec.)/G*(1 rad/sec.) is large, it shows that the moderation course by the dispersion of the fine particles does not effectively exist, and the value thereof is preferably not larger than 7, and more preferably not larger than 5.

Furthermore, it is suitable that the toner of this invention satisfies the following viscoelastic condition (3), Viscoelastic condition (3); Tan δ (loss elastic modulus G"/storage elastic modulus G') in the viscoelasticity of the toner measured at a temperature at which the dynamic complex elastic modulus $G^{*1}$ (distortion ratio 100%, frequency 10 rad/sec.) of said binder resin becomes 1000 Pa is at least 1.1.

The viscoelastic condition (3) is an index for showing that the toner is liable to be smashed at fixing. If tan δ (loss elastic modulus G"/storage elastic modulus G') is less than 1.1, there is a possibility that the glossiness of the image formed is spoiled and coloring becomes insufficient.

To improve the dispersibility of the above-described fine particles, there are a method of preventing the occurrence of the aggregation of the fine particles by modifying the surfaces of the particles with a silane coupling agent, a method of dispersing the fine particles using a strong kneader, etc. However, in the former method, it is difficult to completely prevent the occurrence of the aggregation of the particles of the particle sizes of an 0.1 μm order, and in the latter method, it is even difficult to loosen the particles once aggregated. However, by repeating the operations of kneading, cooling, roughly grinding, and re-kneading plural times, the dispersibility of the fine particles can be improved to some extent. Also, by using a dispersing agent made of a surface active agent and a high molecular material together, the dispersibility of the fine particles can be improved to some extent. Moreover, to improve the dispersibility of the fine particles, a method of wetting the fine particles with water or an organic solvent and then kneading the particles with a binder resin (hereinafter, is referred sometimes to as a wet dispersing method) is suitably used. As the wet dispersing method, practically, the following methods are suitable.

That is, to a liquid (for example, water, an alcohol, etc.) which scarcely swell or dissolve the fine particles are added the fine particles by dropping or spraying, etc. Fine particles the surfaces of which are wetted with a liquid are added to a binder resin heat-molten at a temperature of from 80° C. to 180° C. in a kneader capable of heat kneading. The fine particles are transferred from a liquid phase to a binder resin while kneading and dispersed therein by removing a liquid. If necessary, a finishing dispersion may be carried out by roller or a kneader. The method (hereinafter, is sometimes referred to as a flashing treatment method) can be suitably used as a wet dispersion method.

The above-described flashing treatment method is a method which has hitherto been used in the case of dispersing pigments but can be also suitably used in the case of dispersing the fine particles. In the above-described flashing treatment method, because the fine particles exist in a liquid and the potential obstruction among the particles can be greatly reduced as compared with in air, the aggregates formed can be loosened by a very slight external force and also, as the case may be, by using a surface active agent, etc., the occurrence of the re-aggregation can be prevented. Furthermore, from the same effects, the following methods can be also suitably used.

That is, into a solvent (for example, tetrahydrofuran (hereinafter, is sometimes referred to as THF), toluene, etc.) dissolving a binder resin are added the fine particles, and are dispersed by a supersonic dispersing means, a sand mill, etc. A solvent containing the fine particles is mixed with a binder resin or a solution dissolving a binder resin to dissolve the binder resin in the solvent containing the fine particles. By removing the solvent under a reduced pressure, the fine particles are dispersed in the binder resin. The method (hereinafter, is sometimes referred to as a solvent treatment method) can be suitably used because the same effect as the above-described flashing treatment method is obtained.

When organic fine particles are used as the above-described fine particles, because when an organic solvent is used, swelling or a dissolution of the organic fine particles is liable to occur, it is suitable to use the flashing treatment method. Also, when inorganic fine particles are used as the fine particles, it is suitable to use the solvent treatment method.

As the above-described fine particles, there are organic fine particles and inorganic fine particles and they may be used single or as a mixture of two or more kinds. As the organic fine particles, organic crosslinked fine particles described below are suitably used.

There is no particular restriction on the above-described organic fine particles, and for example, a single resin of a vinyl-base, a styrene-base, a (meth)acryl-base, an ester-base, an amide-base, a melamine-base, an other-base, an epoxy-base, etc., or the copolymer resin of them can be used. In these resins, from the view point of the actual using results in the electrophotographic field, an addition polymerization-series resin typified by a vinyl-base resin, a styrene-base resin, and a (meth)acryl-base resin and a polycondensation-base resin typified by an ester-base resin are preferably used.

There is no particular restriction on the production method of the above-described organic fine particles, and the fine particles can be produced using a known method. For example, as the production method of the addition polymerization-series resin particles, there are the suspension polymerization, the emulsion polymerization, the dispersion polymerization, etc., described in "Experimental Chemistry Course 28, High Molecular Synthesis, 4th edition" (Maruzen K.K.) "Experimental Chemistry Course 29, High Molecular Material, 4th edition" (Maruzen K.K.), "New Edition of High Molecular Experiment 4, Synthesis and Reaction of High Molecule (1), Synthesis of Addition-base High Molecule" (Kyoritsu Shuppan K.K.), "New Edition of High Molecular Experiment 4, Synthesis and Reaction of High Molecule (3), Reaction and Decomposition of High Molecule" (Kyoritsu Shuppan K.K.), etc., can be used. Also, the polymerization granulation methods described in Japanese Patent Laid-Open Nos. 7-18003 (1995), 5-222267 (1993), 5-43608 (1993), 7-228611 (1995), etc., can be used.

Also, as the production method of the polycondensation-base resin particles, the methods described in Japanese Patent Laid-Open Nos. 5-70600 (1993), 7-248639 (1995). etc., and the in-liquid drying method described in Japanese Patent Laid-Open No. 63-25664 (1988), etc., can be preferably used.

There is no particular restriction on the monomers constituting the above-described addition polymerization-series organic fine particles and for example, the known monomer components described in "High Molecular Data Handbook: Basics" (Edited by Kobunshi Gakkai, Baifuukan) can be used singly or as a combination of them. Also those described in the above Japanese Patent Laid-Open documents can be used. Concretely, examples of a vinyl-base monomer include olefinic compounds such as ethylene, propylene, etc., and examples of a styrene-base monomer include styrene and alkyl-substituted styrenes having an alkyl chain, such as α-methylstyrene, vinylnaphthalene, 2-methylstyrene, 3-methylstyrene, 4-methylstyrene, 2-ethylstyrene, 3-ethylstyrene, 4-ethylstyrene, etc.; halogen-substituted styrenes such as 2-chlorostyrene, 3-chlorostyrene, 4-chlorostyrene, etc., and fluorine-styrenes such as 4-fluorostyrene, 2,5-difluorostyrene, etc.

Examples of the (meth) acrylic acid-base monomer include (meth)acrylic acid, n-methyl (meth)acrylate, n-ethyl (methacrylate, n-propyl (meth)acrylate, n-pentyl (meth) acrylate, n-hexyl (meth)acrylate, n-heptyl (meth)acrylate, n-octyl (meth)acrylate, n-decyl (meth)acrylate, n-dodecyl (methacrylate, n-lauryl (meth)acrylate, n-tetradecyl (meth) acrylate, n-hexadecyl (methacrylate, n-octadecyl (meth) acrylate, isopropyl (meth)acrylate, isobutyl (meth)acrylate, t-butyl (meth)acrylate, isopentyl (methacrylate, amyl (meth) acrylate, neopentyl (meth)acrylate, isohexyl (meth)acrylate, isoheptyl (meth) acrylate, isooctyl (meth)acrylate, 2-ethylhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth) acrylate, dimethylaminoethyl (meth)acrylate, diethylaminoethyl (meth)acrylate, methoxyethyl (meth)acrylate, 2-hydroxyethyl (meth)acrylate, (meth) acrylonitrile, and (meth)acrylamide.

Also, examples of a vinyl monomer component having a crosslinking property, which can be preferably used, include diene-base compounds such as isoprene, butadiene, etc.; aromatic divinyl compounds such an divinylbenzene, divinylnaphthalene, etc.; diacrylate compounds bonded with an alkyl chain, such an ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above-described compounds wherein diacrylate is replaced with dimethacrylate; diacrylate compounds bonded with an alkyl chain containing an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above-described compounds wherein diacrylate is replaced with dimethacrylate; ans diacrylate compounds bonded with a chain containing an aromatic group and an ether bond, such as polyoxyethylene(2)-2,2-bis (4-hydroxyphenyl)propane diacrylate, polyoxyethylene(4)-2,2-bis(4-hydroxyphenyl)-propane diacrylate, and the above-described compounds wherein diacrylate is replaced with dimethacrylate; polyfunctional crosslinking agents such as pentaerythritol triacrylate, trimethylolmethane triacrylate, trimethylolpropane triacrylate, tetramethylolmethane tetraacrylate, oligoester acrylate, and the above-described compounds wherein acrylate is replaced with methacrylate.

In these monomers, (meth)acrylic acid, 2-hydroxyethyl (meth)acrylate, acrylamide, etc., having a carboxyl group, a hydroxyl group, an amide, etc., have a high solubility in an aqueous medium and thus when an aqueous medium is used as the continuos phase, as the case may be, the monomer forms super-fine particles singly. In such a case, it is preferred to select the kind of a dispersing agent or an emulsifying agent, or to use the monomer after polymerizing the monomer single or together with other monomer to a molecular weight of about several thousands or lower.

There is no particular restriction on the monomer constituting the above-described polycondensation-base organic fine particles, and for example, there are known dihydric or tri- or higher hydric carboxylic acids and dihydric or tri- or higher hydric alcohols, which are the monomer components described, for example, in "High Molecule Data Handbook: Basics" (Edited by Kobunshi Gakkai, Baifuukan). Also, the monomers described in the above-described patent publications can be used. Practical examples of the monomer described above are illustrated below.

Examples of the dihydric carboxylic acid include dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, mesaconic acid, etc., and the anhydrides and the lower alkyl eaters of them; and aliphatic unsubstituted dicarboxylic acids such as maleic acid, fumaric acid, itaconic acid, citraconic acid, etc.

Examples of the tri- or higher carboxylic acid include 1,2,4-benzenetricarboxylic acid, 1,2,5-benzenetricarboxylic acid, 1,2,4-naphthalenetricarboxylic acid, etc., and the anhydrides and the lower alkyl esters of them. They may be used singly or as a mixture of two or more kinds of them.

Examples of the dihydric alcohol include bisphenol A, hydrogenated bisphenol A, the ethylene oxide and/or propylene oxide addition product of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, neopentyl glycol, etc.

Examples of the tri- or higher alcohol include glycerol, trimethylolethane, trimethylolpropane, pentaerythritol, etc.

They may be used singly or as a mixture of two or more kinds of them. In addition, if necessary, for the purpose of controlling the acid value or the hydroxyl value, a monohydric acid such as acetic acid, benzoic acid, etc., or a monohydric alcohol such as cyclohexanol, benzyl alcohol, etc., can be used.

It may be allowed that the above-described organic fine particles are changed to some extent by the heat added by the flashing treatment or kneading but it is undesirable that the fine particles are melted and flow. That is, it is preferred that the organic fine particles have a heat resistance. When the organic fine particles flow by heat, the viscoelastic range of this invention is deviated and the effect of preventing the occurrence of the penetration phenomenon is weakened. Furthermore, when the fine particles are aggregated, the re-dispersion becomes difficult. Accordingly, as the above-described organic fine particles, the organic fine particles having a crosslinked structure obtained using the tri-hydric or higher monomer are suitable and when the organic fine particles have substantially no crosslinked structure, the organic fine particles wherein the glass transition temperature Tg or the melting temperature Tm is at least 130° C., and preferably at least 150° C. are suitable.

As the organic fine particles, a product property synthesized by the above-described production method may be used or a commercially available product may be used. As the commercially available products, there are those described in "New Development of Fine Particle Polymers" edited by Toray Research Center K.K., and microgel series manufactured by NIPPON PAINT CO., LTD., STANDEX series manufactured by JSR K.K., and MR series and MP series manufactured by Soken Kagaku K.K. are easily available.

As the above-described inorganic fine particles, colorless or light-color inorganic fine particles having a mean particle size of from 1 to 300 nm are suitable. The inorganic fine particles may be metal oxides or non-oxides, and practical examples thereof include silica, alumina, titanium oxide, barium titanate, magnesium titanate, calcium titanate, strontium titanate, zinc oxide, silica sand, clay, mica, siliceous sand, diatomaceous earth, cerium chloride, iron oxide red, chromium oxide, cerium oxide, antimony trioxide, magnesium oxide, zirconium oxide, silicon carbide, silicon nitride, etc.

As the synthesis method of the fine particles of a metal oxide, there are, for example, a method of synthesizing by hydrolyzing a chloride (e.g., silicon tetrachloride, titanium tetrachloride, and aluminum tetrachloride) in a vapor phase, a method of synthesizing by a wet method, and a method of synthesizing by a high-temperature melting method. Also, as a synthesis method of the fine particles of a non-oxide, there are a method of synthesizing by a chemical vapor phase method, etc.

As the above-described inorganic fine particles, titanium-base fine particles and silica fine particles are preferable and these fine particles subjected to a hydrophobic treatment with a hydrophobic property-imparting agent are preferably used.

The hydrophobic property-imparting agent includes a coupling agent (for example, silane-base coupling agent, a titanate-base coupling agent, an aluminate-base coupling agent, and a zirconium-base coupling agent), a silicone oil, etc. In these materials, a silane-base coupling agent and a silicone oil are preferred. These hydrophobic property-imparting agents may be used singly or as a mixture of two or more kinds thereof.

As the silane-base coupling agent, chlorosilane, alkoxysilane, a specific silylating agent, etc., can be used. Practical examples of the silane-base coupling agent include methyltrichlorosilane, dimethyldichlorosilane, trimethylchlorosilane, phenyltrichlorosilane, di-phenyldichlorosilane, tetramethoxysilane, methyltrimethoxysilane, dimethyldimethoxysilane, ethyltrimethoxysilane, propyltrimethoxysilane, phenyltrimethoxysilane, diphenyldimethoxysilane, tetraethoxysilane, methyltriethoxysilane, methyltriethoxysilane, dimethyldiethoxysilane, ethyltriethoxysilane, propyltriethoxysilane, phenyltriethoxysilane, diphenyldiethoxysilane, butyltrimethoxysilane, butyltriethoxysilane, isobutyltrimethoxysilane, octyltrimethoxysilane, decyltrimethoxysilane, hexadecyltrimethoxysilane, trimethyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, vinyltriacetoxysilane, γ-methacryloxypropyltrimethoxysilane, β-(3,4-epoxycyclohexyl) ethyltrimethoxysilane, γ-glycidoxypropyltrimethoxysilane, γ-glycidoxypropyltriethoxysilane, γ-glycidoxypropylmethyldiethoxysilane, γ-mercaptopropyltrimethoxysilane, γ-chloropropyltrimethoxysilane, fluorine-base silane compounds obtained by substituting a part of the hydrogen atoms of these above-described compounds with a fluorine atom, and amino-base silane compounds obtained by substituting a part of the hydrogen atoms of these above-described compounds with an amino group. However, the silane-base coupling agents used in this invention are not limited to these compounds.

Examples of the above-described silicone oil include a dimethyl silicone oil, a methylhydrogen silicone oil, a methylphenyl silicone oil, a cyclic dimethyl silicone oil, an epoxy-denatured silicone oil, a carboxyl-denatured silicone oil, a carbinol-denatured silicone oil, a methacryl-denatured silicone oil, a mercapto-denatured silicone oil, a polyether-denatured silicone oil, a methylethyl-modified silicone oil, an alkyl-denatured silicone oil, an amino-denatured silicone oil, and a fluorine-denatured silicone oil but the invention is not limited to these compounds.

As the hydrophobic treatment method of the fine particles, a known method may be used and, for example, there are a method of treating by forcibly applying dropwise or by spraying a solvent solution of the hydrophobic property-imparting agent mixed and diluted with a solvent (such as, THF, toluene, ethyl acetate, methyl ethyl ketone, acetone, etc.) to the fine particles followed by sufficiently mixing by a blender, etc., after, if necessary, washing and filtering, drying by heating, and grinding the dried aggregates by a blender, a mortar, etc.; a method of treating by immersing the fine particles in a solvent solution of the hydrophobic property-imparting agent, precipitating the fine particles, drying the precipitated fine particles by heating, and grinding the precipitates; a method of treating dispersing the fine particles in water to form a slurry, after adding dropwise the slurry to a solvent solution of the hydrophobic property-imparting agent, precipitating the fine particles, and after drying by heating, grinding the precipitates; a method of treating by directly spraying the hydrophobic property-imparting agent onto the fine particles, etc.

The attached amount of the hydrophobic property-imparting agent to the fine particles is preferably from 0.01 to 50% by weight, and more preferably from 0.1 to 25% by weight to the fine particles. The attached amount can be changed by changing the mixing amount of the hydrophobic property-imparting agent in the step of the hydrophobic treatment or changing the number of washing steps after the hydrophobic treatment. Also, the attached amount can be determined by XPS or an elemental analysis. If the attached amount is less than 0.01% by weight, the electrostatic charging property is sometimes lowered under a high-humidity state, and if the attached amount exceeds 50% by weight, it sometimes happens that charging under low humidity becomes excessive and the liberated hydrophobic property-imparting agent reduces the powder fluidity of the developer.

Examples of the above-described binder resin include an ethylene-base resin such as polyethylene, polypropylene, etc.; a styrene-base resin such as polystyrene, α-polymethylstyrene, etc.: a (meth)acryl-base resin such as polymethyl methacrylate, polyacrylonitrile, etc.; a polyamide resin, a polycarbonate resin, a polyether resin, a polyester resin, and copolymer resins of them. In these resins, from the view point of the charging safety and the development resistance in the case of using as a toner, the (meth)acryl-base resin, the styrene-(meth)acryl-base copolymer resin, and the polyester resin are preferred. Also, from the view point of a low-temperature fixing property and the vinyl chloride attaching resistance, the polyester resin is more preferred.

As the monomers constituting the above-described styrene-base resin, (meth)acryl-base resin, and the copolymer resins of them, the monomers illustrated above as the addition polymerization-series monomers constituting the above-described organic fine particles can be preferably used. However, because in the case of using for the binder resin, there is a possibility that a large amount of a crosslinking component reduces the coloring property of the toners, it is preferred that the amount of the crosslinking component is 5 mole % or less. The above-described monomers are properly combined and the binder resin can be produced by an ordinary method.

As the above-described polyester resin, a non-crystalline polyester resin is preferred. The use of the non-crystalline polyester resin is advantageous in the point that the resin itself becomes white turbid by the scattering of light by crystals as the case of using a crystalline polyester resin. In the present invention, the non-crystalline polyester resin means a polyester resin which does not show an endothermic peak corresponding to the melting point of a crystal in addition to the endothermic point corresponding to Tg in the chart of a differential scanning calorimetry (hereinafter, is referred to as "DSC").

As other monomer(s) used for the polyester resin, the monomer(s) illustrated above as the polycondensation-series monomers constituting the above-described organic fine particles can be preferably used. As the case of the addition polymerization-series monomers, it is preferred that the using amount of the trihydric or higher crosslinking monomer is not more than 5 mole % of the total monomers.

The above-described polyester resin can be synthesized using the known methods described in "Polycondensation" (Kagaku Doojin), "High Molecule Experiment" (Polycondensation and Polyaddition; Kyoritsu Shuppan), "Polyester Resin Handbook" (edited by Nikkan Kogyo Shimbun Sha), and a transeserification method, a direct polycondensation method, etc., can be used singly or as a combination of them.

It is preferred that the binder resin does not substantially contain a tetrahydrofuran (hereinafter, is sometimes referred to THF) insoluble component regardless of a styrene-base, an acryl-base, and a polyester-base. This is because in the case of containing a THF insoluble component, the offset resistance is improved but it sometimes happens that the glossiness of the image formed is spoiled and the OHP light transmittance is reduced. The THF insoluble component can be measured by dissolving a resin in THF at a concentration of about 10% by weight, the solution is filtered with a membrane filter, etc., and after drying the filter residue, measuring the weight of the residue.

As the molecular weight of the binder resin, in the case of the styrene-base resin, the (meth)acryl-base resin, or the styrene-(meth)acryl-base resin, the weight average molecular weight (hereinafter, is sometimes referred to as Mw) and the number average molecular weight (hereinafter, is sometimes referred to as Mn) are preferably from 30,000 to 100,000 and from 2000 to 30,000 respectively, and more preferably from 35,000 to 80,000 and from 2500 to 20,000. In the case of the polyester resin, it is preferred that Mw is from 5000 to 40,000 and Mn is from 2000 to 10,000 and it is more preferred that Mw is from 6000 to 30,000 and Mn is 2500 to 8000. This is because when Mw and Mn are too high, the lowest fixing temperature is raised and when they are too low, the image strength after fixing is hard to obtain. Also, it is preferred that the binder resin has an acid value of from 10 to 50 KOH mg/g from the view point of electrostatic charging property.

The above-described molecular weight and the molecular weight distribution can be measured by a known method but are generally measured by a gel permeation chromatography (hereinafter, is sometimes referred to as GPC). The GPC measurement can be carried out by using, for example, HLC-802A manufactured by TOSOH CORPORATION as a GPC apparatus in the conditions of a column flow rate of 1 ml/minutes and a sample injection amount of 0.1 ml and in this case, the concentration of the sample is 0.5% and THF for GPC manufactured by Wako Pure Chemical Industries, Ltd., is used. Also, the calibration curve can be prepared using, for example, a standard polystyrene sample manufactured by TOSOH CORPORATION. The above-described molecular weight and the molecular weight distribution in this invention were measured as described above.

There is no particular restriction on the coloring agents and they can be properly selected from known coloring agents according to the purposes. Examples of the coloring agents include carbon black, lamp black, Aniline Blue, Ultramarine Blue, Chalcoyl Blue, Methylene Blue Chloride, Copper Phthalocyanine, Quinoline Yellow, Chrome Yellow, Du Pont Oil Red, Orient Oil Red, Rose Bengal, Malachite Green Oxalate, Nigrosine dye, C.I. Pigment Red 48:1. C.I. Pigment Red 57:1, C.I. Pigment Red 81:1, C.I. Pigment Red 122, C.I. Pigment Yellow 97, C.I Pigment Yellow 12, C.I. Pigment Yellow 17, C.I. Pigment Blue 15:1, C.I. Pigment Blue 15:3, etc.

The content of the coloring agent in the electrophotographic toner is preferably from 1 to 30 parts by weight to 100 parts by weight of the binder resin, but the amount is as large as possible in the range of reducing the smoothness of the surface of the image containing the coloring agent. When the content of the coloring agent is increased, in the case of forming the image of a same density, the thickness of the image can be thinned and is advantageous in the point of effective for prevention of offset. In addition, according to the kind of the above-described coloring agents, a yellow toner, a magenta toner, a cyan toner, a black toner, etc., can be obtained.

In the toners of this invention, there are no particular restrictions on other components and they may be properly selected according to the purposes. For example, as other components, there are known various additives such as internal additives (such as a low-melting lubricant, a charging controlling agent, etc.) and external additives (such as other inorganic fine particles, other organic fine particles, etc.).

The low-melting lubricant is generally used for improving the offset resistance and practical examples thereof include a wax, stearic acid, alkyl fatty acids (e.g., montanic acid, etc.), fatty acid metal salts (e.g., calcium stearate, zinc stearate, magnesium stearate, calcium stearate, etc.), and alcohol-base releasing agents (e.g., stearyl alcohol, etc.). In these materials, from the view point of easiness of controlling charging property, a wax is preferred.

Examples of the wax include aliphatic hydrocarbon-base waxes (e.g., low-molecular polyethylene having a branched structure in the molecule, low-molecular polypropylene, microcrystalline wax, tetratetracontane, octacontane, etc.), denatured aliphatic hydrocarbon-base waxes (e.g., the denatured polyethylene-base releasing agents as described in Japanese Patent Laid-Open No. 9-134035 (1997), etc.), a carnauba wax, a candelilla wax, a rice wax, a sanzole wax, aliphatic waxes (e.g., montanic acid ester, etc.), deoxidized products of aliphatic waxes, silicone resins, and rosins. In these waxes, the waxes having a melting point of from 40° C. to 150° C. are preferred and waxes having a melting point of from 70° C. to 110° C. are more preferred.

The content of the wax is preferably not more than 10% by weight. If the content of the wax is too much, there is a possibility of deteriorating the color image quality and the reliability by that the wax on the surface and the inside of the fixed color images deteriorates the projecting property of OHP, that in the case of using as two-component developer, by the friction of the toner and the carriers, the wax transfers to the carriers to change the charging faculty of the developer with the passage of time, that similarly in the case of using a one-component developer, by the friction of the toner and a blade for charging, the wax transfers to the blade to change the charging faculty of the developer with the passage of time, and that the wax deteriorates the fluidity of the toner.

The above-described charging controlling agent is generally used for improving the electrostatic charging property and practical examples thereof include salicylic acid metal salts, metal-containing azo compounds, Nigrosine, and quaternary ammonium salts.

The above-described other inorganic fine particles are generally used for improving the fluidity of the toner and practical examples thereof include silica, alumina, titanium oxide, barium titanate, magnesium titanate, calcium titanate, strontium titanate, zinc oxide, silica sand, clay, mica, siliceous sand, diatomaceous earth, cerium chloride, iron oxide red, chromium oxide, cerium oxide, antimony trioxide, magnesium oxide, zirconium oxide, silicon carbide, silicon nitride, etc. In these materials, the titanium-base fine particles and silica fine particles are preferred, and these fine particles subjected to a hydrophobic property-imparting treatment are particularly preferred. The primary particle sizes of the inorganic fine particles are preferably from 1 to 1000 nm and the addition amount thereof is preferably from 0.01 to 20 parts by weight to 100 parts by weight of the toner.

The above-describe other organic fine particles are generally used for improving the cleaning property and the transferring property and practical examples thereof include polystyrene, polymethyl methacrylate, and polyvinylidene fluoride. Also, the organic fine particles the surfaces of which are treated with a silicone-base compound or a fluorine-base compound are suitably used.

Because the toner of this invention contains the above-described fine particles with a good dispersibility, even in the case of using a binder resin having a low grass transition temperature Tg and a low melting temperature Tm, the heat blocking resistance of the powder toners each other, the fixed image and a paper, and the fixed images each other can be obtained, whereby the fixing temperature can be lowered and fixing can be carried out with energy saving. In this case, the heat blocking resistance means a performance to the trouble that when a toner or images formed are allowed to stand at a temperature higher than normal temperature a little, for example, when they are allowed to stand in a car or a warehouse in summer, the toner particles stick to each other or the piled images stick to papers.

In the case of a toner of prior art, without using a binder resin having a glass transition temperature Tg of at least about 60° C. and a melting temperature Tm of at least 100° C., a sufficient heat blocking resistance of powder toners each other, the fixed image and a paper, and the fixed images each other could not be obtained. On the other hand, in the toner of this invention containing the above-described fine particles with a good dispersibility, even by using a bender resin having a low glass transition temperature and a low meting temperature, a sufficient heat blocking resistance is obtained. The reason is conjectured as follows.

Heat blocking is considered to be initiated by that first the low molecules of the binder resin existing near the surface of a toner diffuse and move to adhere the toner particles to each other and adhere a toner image to a paper or toner images to each other, but in the toner of this invention, it is considered that the fine particles dispersed in the binder resin restrain the diffusion and movement of the low molecular components of the binder resin to prevent the occurrence of heat blocking. The consideration that fine particles retrain or restrict the diffusion of surrounding solvent molecules thereof is shown in literatures of other material system than the field of the present invention. For example, the explanation of the rheological behavior of an aqueous dispersion of fine particles by the existence of the fine particles was considered using the effect that particle sizes of the particles became larger than the actual particle sizes by a hydrated layer. It is conjectured that in the toner of this invention, because the fine particles are very close to each other as the surface distance between the particles being from about 10 to 50 nm, a considerably large amount of the binder resin molecules are near the surfaces of the fine particles and because the molecules are restricted to the fine particles by the intermolecular interaction, etc., the heat blocking resistance appears. Also, as an anti-blocking agent of coating materials, etc., particles having particle sizes of about 1 μm larger than the above-described fine particles are effective and this is a means of forming fine projections on the coated surface to avoid a surface contact with other materials and to made a point contact. However, particles having particle sizes of 500 nm or larger do not have a so good effect for the heat blocking resistance of toner particles each other as well as do not increase the smoothness of the image formed, and thus such particles are unsuitable for the formation of color images.

The glass transition temperature Tg of the binder resin in this invention is preferably from 40 to 100° C., more preferably from 40 to 85° C., and far more preferably from 50 to 75° C. If Tg is lower than 40° C., the toner is liable to be blocked by heat, while if Tg is higher than 100° C., the fixing temperature becomes too high. Tg can be measured using a differential scanning calorimeter (DSC3110, Thermal analysis system 001, manufactured by Mack Science Co.) under the condition of a temperature-raising rate of 5° C./minute and the temperature of the shoulder at the low-temperature side of the endothermic point corresponding to Tg of the chart obtained can be defined to be Tg.

The melting temperature Tm of the binder resin is preferably from 60 to 100° C., more preferably from 60 to 90° C., and far more preferably from 60 to 80° C. If Tm is lower than 60° C., the toner is liable to be blocked by heat, while if Tm is higher than 100° C., the fixing temperature becomes too high.

Furthermore, to sufficiently obtain the effect of the heat blocking resistance, it is suitable to further use a low melting lubricant. The low melting lubricant oozes on the surface of the image at a fixing step to form a film of several tens nm on the surface of the image. The film functions to further block the diffusion and movement of the low molecular component of the binder resin restrained by the fine particles and impart a good heat blocking resistance even under severe condition that the temperature becomes higher a little than about the glass transition temperature Tg and the melting temperature Tm of the binder resin.

As the low melting lubricant, there are low melting lubricants used for improving the offset resistance described above. In these lubricants, the low melting lubricant having a melting point of 100° C. or lower is preferred. The content of the above-described low melting lubricant is preferably from 3 to 10% by weight, and more preferably from 3 to 7% by weight.

As the above-described fine particles, from the view point of sufficiently obtaining the effect of the heat blocking resistance, the fine particles having a mean particle size of from 1 to 300 nm are suitable. Furthermore, from the view point of capable of increasing the heat shelf life of the toner powder, it is suitable that the above-described fine particles contain fine particles having a different mean particle size. Practically, it is suitable that the fine particles comprise the fine particles having a mean particle size of from 30 to 200 nm, and preferably from 30 to 150 nm, and fine particles having other mean particle size. When other mean particle size of fine particles is smaller than the fine particles having the mean particle size of from 30 to 200 nm, the fine particles having the mean particle size thereof is from 1 to 30 nm, and preferably from 5 to 30 nm are suitable, and when other mean particle size of fine particles is larger than the fine particles having the mean particle size of from 30 to 200 nm, the fine particles having the mean particle size thereof is from 200 to 300 nm are suitable.

Because the toner of this invention contain the above-described fine particles with a good dispersibility, even in the case of using the binder resin having a low glass transition temperature Tg and a low melting temperature Tm, a heat blocking resistance of the powder toner each other, the fixed image and a paper, and the fixed images each other can be obtained, and further by containing the low melting lubricant, a sufficient heat blocking resistance can be obtained. Thus, the toner of this invention containing the low melting lubricant in addition to the above-described fine particles can lower the fixing temperature while keeping a good releasing property even in the toner which is fixed under an oil-less condition.

In the case of fixing under an oil-less condition, not only the offset resistance of the toner but also the winding resistance (avoiding the phenomenon that a paper having a toner layer is wound around with the toner layer as an adhesive layer) around a fixing apparatus must be insured, for the purpose, only the releasing effect by the low melting lubricant is insufficient and it is suitable that the binder resin has the specific viscoelastic characteristics.

As the viscoelastic characteristics of the binder resin obtaining a good winding resistance, it is necessary that the energy loss by the viscosity change in a releasing deformation is restrained less, that is, it is suitable that between the glass transition temperature of the binder resin and the temperature at which the loss elastic modulus G" of the binder resin, tan δ (less elastic modulus G"/storage elastic modulus G') in the viscoelasticity of the binder resin has the minimum value and the minimum value is less than 1.2. In the deformation of releasing the toner from the surface of a fixing apparatus, from that the thickness of the toner layer is thin as about 10 μm, the actual releasing deformation speed of the toner becomes very high, and from a time conversion rule of the temperature of the viscoelasticity and time, the viscoelasticity of the binder resin near the temperature about the latter half of the glass transition temperature gives large influences on the releasing deformation.

In the binder resin for obtaining such viscoelastic characteristics, the weight average molecular weight is from about 15,000 to 20,000 in the case of a polycondensed resin and from about 40,000 to 60,000 in the case of a vinyl-base resin, and it is necessary to increase the weight average molecular weight to at least 1.5 times the molecular weight of a resin suitable for fixing using an oil. Consequently, the fixing temperature is inevitably raised. However, as described above, because when the glass transition temperature and the melting temperature are lowered, the good heat blocking resistance characteristics are obtained, even in this case, low-temperature fixing become possible.

The toner of this invention can be produced according to a known production method. There is no particular restriction on the production method, and the method can be properly determined according to the purpose. For example, there are a knead-grinding method, a knead refrigeration grinding method, an in-liquid drying method (Japanese Patent Laid-Open No. 63-25664 (1988)), a method of forming fine particles by shear-stirring a molten toner in an insoluble liquid, a method of dispersing the binder resin and a coloring agent in a solvent and forming fine particles by jet-spraying the dispersion, a suspension polymerization method (Japanese Patent Laid-Open No. 5-61239 (1993)), etc., and in these methods, the knead-grinding method is preferred. In the knead-grinding method, the binder resin, the coloring agent, and other additives are melt-kneading using a bambury-type kneading machine, a twin screw-type kneading machine, etc., grinding is carried out by a hammer mill, a jet-type grinding machine, etc., and the ground mixture is classified by an inertia force classifier, etc., to obtain a toner. The method is excellent in the points that the toner can be produced with a good material efficiency and at a low cost and also the additives can be internally added with a relatively good dispersibility. According to the method, the fine particles can be internally added by dispersing in the toner without aggregating the fine particles.

The toner of this invention can be suitably used as a toner in an electrophotographic developer.

The electrophotographic developer of this invention may be a one-component system electrophotographic developer containing at least the toner of this invention or may be a two-component system electrophotographic developer containing the toner of this invention and a carrier There is no particular restriction on the carrier and there are known carriers, such as a resin-coated carrier, etc. The resin-coated carrier is prepared by coating a resin on the surface of a core material. Examples of the core material include powders having a magnetism, such as, an iron powder, a ferrite powder, a nickel powder, etc. Examples of the above-described resin include a fluorine-base resin, a vinyl-base resin, a silicone-base resin, etc.

The electrophotographic developer of this invention may contain properly selected additives according to the purposes. For example, the developer may contain a metal showing a ferromagnetism, such as irons (e.g., iron, ferrite, and magnetite), nickel, cobalt, etc., alloys thereof, and the compound, magnetic materials, and magnerizable materials containing each of these metals for the purpose of obtaining a magnetism.

The electrophotographic developer of this invention can be suitably used for various image-forming processes.

The image-forming process of this invention uses the electrophotographic developer of this invention as an electrophotographic developer. The image-forming process of this invention includes known image-forming steps, such as, for example, a step of forming an electrostatic latent image on a latent image support, a step of forming a toner image by developing the latent image using the electrophotographic developer, a step of transferring the developed toner image onto a transfer material, and a step of fixing the toner image on the transfer material. In the step of transferring the developed toner image onto a transfer material, the developed toner image is first transferred onto an intermediate transfer material, and further the transferred toner image on the intermediate transfer material may be transferred onto the transfer material. In this case, the intermediate transfer material may be a roller-form material or a belt-form material. Also, the transfer and fixing may be carried out simultaneously.

The fixing apparatus, which can be used for the image-forming process of this invention, a heat-contact type fixing apparatus can be used. For example, a heat-roller fixing apparatus comprising a heat roller having a rubber elastic layer on a core metal and, if necessary, equipped with a fixing member surface layer and a press roller having a rubber elastic layer on a core metal and, if necessary, equipped with a fixing member surface layer or a fixing apparatus wherein the above-described combination of the roller and the roller is replaced with a combination of a roller and a belt or a combination of a belt and a belt can be used.

For the image-forming process of this invention, a fixing apparatus equipped with a known releasing agent coating means can be used or a so-called oil-less fixing apparatus having no releasing agent coating means can be used. In the case of using the fixing apparatus equipped with a known releasing agent coating means, the supplying amount of the releasing agent may be properly selected but is suitably not more than 2 mg/A4 ($210\times297$ $mm^2$).

As the above-described rubber elastic layer, a heat resisting rubber such as a silicone rubber, a fluorine rubber, etc., is used and the thickness thereof is preferably from 0.1 to 3 mm and the rubber hardness is preferably 60 or lower. It is advantageous that the above-described fixing member has the elastic layer in the points that the fixing member is deformed in conformity with the unevenness of the toner image on the transfer material and thus the smoothness of the surface of the image after fixing can be improved. If the thickness of the above-described elastic layer is too thick, the heat capacity of the above-described fixing member becomes large and thus a long time is required for heating the fixing member as well as the consumed energy is increased, which are undesirable. Also, it is undesirable that the thickness of the elastic layer is too thin, in the points that the deformation of the fixing member cannot follow the unevenness of the toner image to form uneven melt and that a strain of the elastic layer effective for releasing is not obtained.

As the fixing member surface layer, a silicone rubber, a fluorine rubber, a fluorine latex, or a fluorine resin is used. In these materials, the fluorine resin is excellent in the point of the abrasion resistance. As the fluorine resin, a soft fluorine resin containing teflon, vinylidene fluoride, etc., such as PFA (perfluoroalkoxyethyl ether copolymer), etc., can be used. As the base material (core) of the fixing member, a material having an excellent heat resistance, a high strength to deformation, and a good heat conductivity is selected, in the case of a roll-type fixing apparatus, for example, aluminum, iron, copper, etc., is selected, and in the case of a belt-type fixing apparatus, for example, a polyimide film, a stainless steel-made belt, etc., is selected.

The fixing member elastic layer and the surface layer may contain various additives according to the purposes, and, for example, may contain carbon black, a metal oxide, ceramic particles such as SiC particles, etc., for the purposes of improving the abrasion resistance, controlling the resistance, etc.

The above-described fixing member may be coated with a releasing agent such as a silicone oil, etc., for improving the releasing property and improving the abrasion resistance. There is no particular restriction on the releasing agent, and there are liquid releasing agents, for example, heat resisting oils such as a dimethylsilicone oil, a fluorine oil, a fluorosilicone oil, etc., and denatured oils such as an amino-denatured silicone oil, etc.

As the above-described transfer material (recording material), there are, for example, a plain paper and an OHP sheet used for an electrophotographic copying machine, an electrophotographic printer, etc. The transfer material having particularly the surface smoothness of 80 sec. or lower is suitable in the view point of obtaining the effect of the penetration prevention. The surface smoothness is the value measured according to JIS P8119. In the case of more improving the smoothness of the image surface after fixing, a transfer material the surface of which is as smooth as possible may be used, and there are, for example, a coated paper obtained by coating the surface of a plain paper with a resin, etc., or an art paper for printing.

Figure 2:
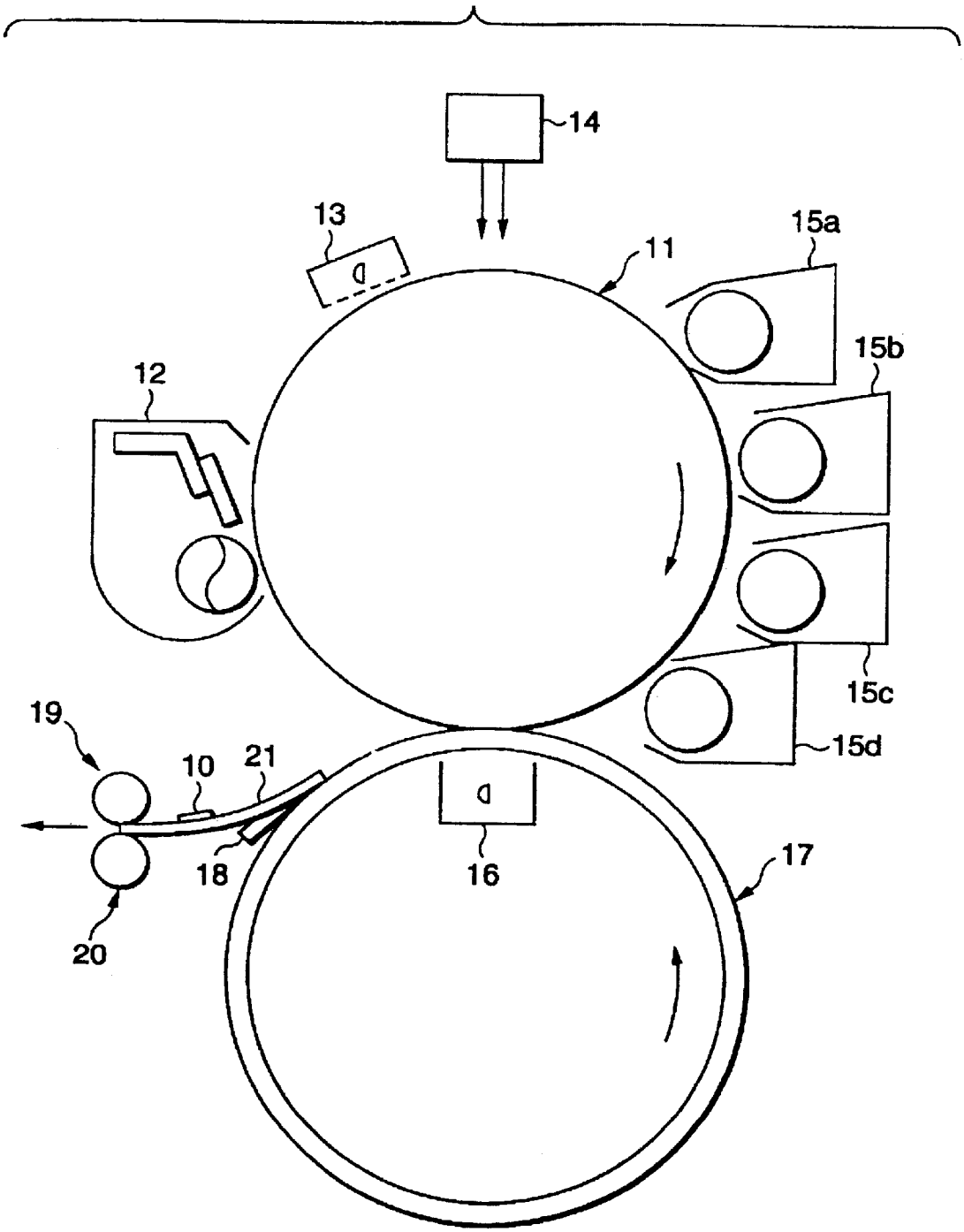
FIG. 2 is a schematic constructional view showing an embodiment of an image-forming apparatus suitably used for the image-forming process of this invention.

FIG. 2 is a schematic constructural view showing an embodiment of an image-forming apparatus suitably used for the image-forming process of this invention.

The image-forming apparatus shown in FIG. 2 is equipped with a photoreceptor 11 and around the photoreceptor 11 are disposed a cleaner 12, a charging device 13, a light-exposure device 14, developing devices 15*a*, 15*b*, 15*c*, and 15*d* containing the developers of cyan, magenta, yellow, and black respectively, and a transfer roll 17 in this order. In the inside of the transfer roll 17 is formed a transfer charging device 16 facing the photoreceptor 11. A releasing claw 18 is formed around the transfer roll 17. Also, a pair of heat roll fixing device composed of a heat roller 19 and the press roller 20 for fixing a toner image 10 transferred onto a transfer material 21 by the transfer roll 17 is disposed.

When the image-forming apparatus shown in FIG. 2 is used, images are formed as follows.

The photoreceptor 11 electrostatically charged by the charging device 13 is light-exposed by a light-exposure device 14 to form an electrostatic latent image on the photoreceptor 11. The latent image on the photoreceptor 11 is successively developed by the developing devices 15*a*, 15*b*, 15*c*, and 15*d* to form a toner image 10. The developed toner image 10 is applied with a bias electric charge having a reverse polarity to the friction charge of the toner by the transfer charging device 16 and is transferred onto the transfer material 21. The transfer material 21 is released from the transfer roll 17 by a releasing claw 18 with the rotation of the transfer roll 18. The toner image 10 on the transfer material 21 released by the releasing claw 18 is fixed on the transfer material 21 by passing the transfer material 21 between the heat roller 19 and the press roller 20 to form an image. In addition, after transferring the toner image 10 on the photoreceptor 11 onto the transfer material 21, the toner image 10 remaining on the photoreceptor 11 is removed by the cleaner 12.

Figure 3:
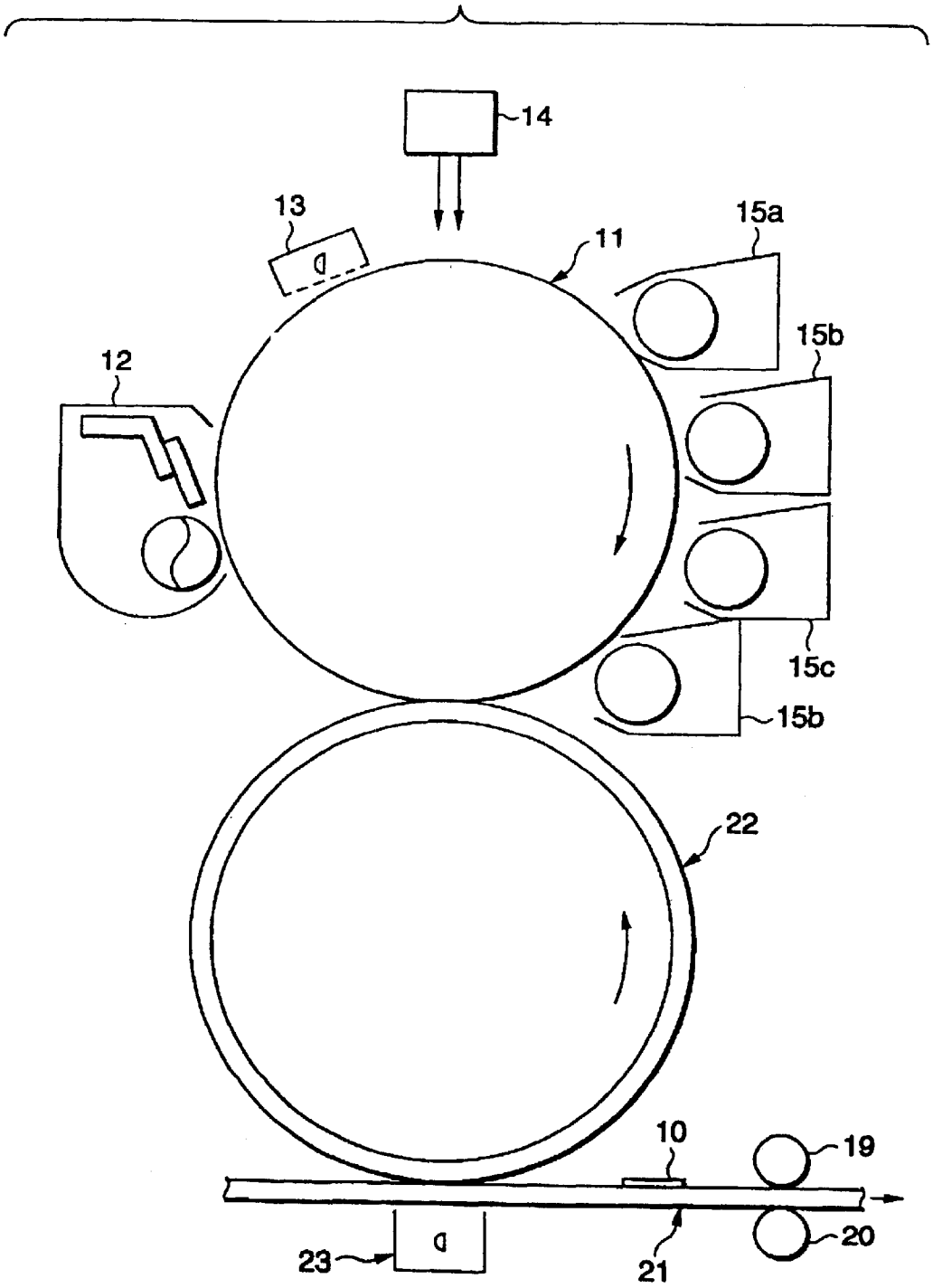
FIG. 3 is a schematic constructional view showing other embodiment of an image-forming apparatus suitably used for the image-forming process of this invention, and FIG. 4 a schematic constructional view showing still other embodiment of an image-forming apparatus suitably used for the image-forming process of this invention.

FIG. 3 is a schematic nonstructural view showing other embodiment of an image-forming apparatus suitably used for the image-forming process of this invention.

In the image-forming apparatus shown in FIG. 3, the construction thereof is same as that of the image-forming apparatus shown in FIG. 2 except that a roll-form intermediate transport material 22 is formed in place of the transfer charging device 16, the transfer roll 17, and the releasing claw 18 of the image-forming apparatus shown in FIG. 2 and a transfer charging device 23 is disposed around the intermediate transfer material 22.

By using the image-forming apparatus shown in FIG. 3, an image is formed as follows.

The photoreceptor 11 charged by the charging device 13 is light-exposed by the light-exposure device 11 to form a latent image on the photoreceptor 11. The latent image on the photoreceptor 11 is successively developed by the developing devices 15*a*, 15*b*, 15*c*, and 15*d* to form a toner image 10. The developed toner image 10 is transferred onto the roll-form intermediate transfer material 22. The toner image 10 on the roll-form intermediate transfer material 22 is applied with a bias electric charge having a reverse polarity to the friction charge of the toner by the transfer charging device 23 and is transferred onto the transfer material 21. The toner image 10 on the transfer material 21 is fixed on the transfer material 21 by passing the transfer material 21 between the heat roller 19 and the press roller 20 to form an image. In addition, after transferring the toner image 10 on the photoreceptor 11 onto the transfer material 21, the toner image 10 remaining on the photoreceptor 11 is removed by the cleaner 12.

Figure 4:
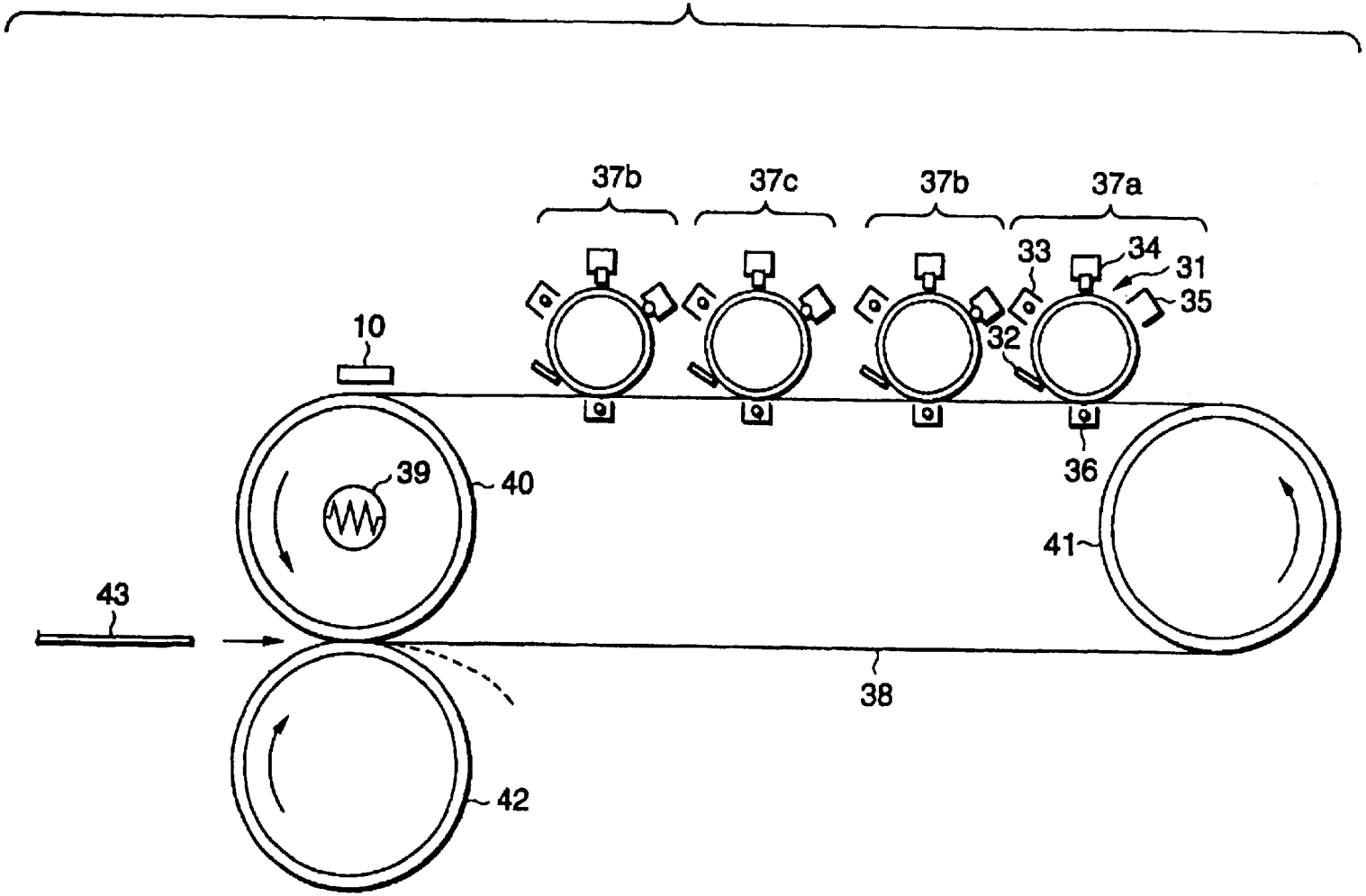

FIG. 4 is a schematic nonstructural view showing still other embodiment of an image-forming apparatus suitably used for the image-forming process of this invention.

The image-forming apparatus shown in FIG. 4 is equipped in development units 37*a*, 37*b*, 37*c*, and 37*d* each having a photoreceptor 31 and around the photoreceptor 31 are successively disposed a cleaner 32, a charging device 33, a light-exposure device 34, a developing device 35, and a transfer charging device 36 in this order. Each of the developing devices 35 of the development units 37*a*, 37*b*, 37*c*, and 37*d* contains each of the developers of cyan, magenta, yellow, and black respectively. Each of the photoreceptors 31 of the development units 37*a*, 37*b*, 37*c*, and 37*d* and each of the transfer charging devices 36 are faced each other via a belt-form intermediate transfer material 38. The belt-form intermediate transfer material 38 is installed on a heating support roller 40 containing a heater 39 and a support roller 41. The heating support roller 40 is in press-contact with a press roller 42 via the belt-form intermediate transfer material 38.

By using the image-forming apparatus shown in FIG. 4, an image is formed as follows.

The photoreceptor 31 charged by the charging device 33 is light-exposed by the light-exposure device 31 to form a latent image on the photoreceptor 31. The latent image on the photoreceptor 31 is developed by the developing device 35 to form a toner image 10. The developed toner image 10 is applied with a bias electric charge having a reverse polarity to the friction charge of the toner by the transfer charging device 36 and is transferred onto the belt-form transfer material 38. After transferring the toner image 10 on the photoreceptor 31 onto the belt-form intermediate transfer material 38, the toner image 10 remaining on the photoreceptor 31 is removed by the cleaner 32. A series of the above-described operations are successively carried out in the order of the development units 37*a*, 37*b*, 37*c*, and 37*d*. The heat roller 40 is rotated such that the toner image of the intermediate transfer material 38 transferred by the development units 37*a*, 37*b*, 37*c*, and 37*d* advances to the direction of the heating support roller 40. The toner image 10 on the belt-form intermediate transfer material 38 is gradually heated with approaching the heating support roller 40 and is melted when the toner image 10 reaches the position of the heating support roller 40. At the case of passing the molten toner image 10 on the belt-form intermediate transfer material 38 between the heating support roller 40 and the press roller 42 in press-contact with the heating support roller 40 via the intermediate transfer material 38, a transfer material 43 is inserted and the toner image 10 is transferred onto the transfer material 43 and simultaneously fixed to form an image.

Even in the heat-transfer system of transferring the toner onto a transfer material as the image-forming apparatus shown in FIG. 4 wherein the belt-forming intermediate transfer material is used and the transfer and fixing are simultaneously carried out, the toner of this invention can be suitably used. This is because in a heat-transfer system wherein the heating time is long at a low pressure and also conveying of a toner image is carried out, the toner of this invention has a yield value to the deformation and the occurrence of the deviation of image is prevented.

EXAMPLES

The invention will be described in more detail with reference to the following Examples and Comparative Examples, which are not intended to restrict the scope thereof.

Example of Synthesis of Polyester Resin (PESa)

A reaction vessel equipped with a stirrer, thermometer, condenser, and nitrogen gas inlet tube was charged with 99.7 parts by weight (hereinafter abbreviated as "pbw") (0.60 mol) of terephthalic acid, 66.5 pbw (0.39 mol) of isophthalic acid, 211.3 pbw (0.65 mol) of bisphenol A-ethylene oxide (2 mol) adduct, 24.2 pbw of ethylene glycol, and 2.0 pbw (0.008 mol) of dibutyltin oxide as a catalyst. With the atmosphere in the reaction vessel replaced with dry nitrogen gas, the solution mixture therein was stirred for reaction at about 200° C. for about 5 hours under a nitrogen gas stream. With the temperature raised to about 240° C., stirring and reaction were continued for about 3 hours. After stirring and reaction, the reaction vessel was evacuated to 10.0 mmHg, and the solution mixture was stirred for reaction under reduced pressure for about 0.2 hours. Thus there was obtained a colorless transparent amorphous polyester resin (PESa), which has characteristic properties as shown in Table 1.

Example of Synthesis of Polyester Resin (PESb)

A reaction vessel equipped with a stirrer, thermometer, condenser, and nitrogen gas inlet tube was charged with 99.7 pbw (0.60 mol) of terephthalic acid, 66.5 pbw (0.39 mol) of isophthalic acid, 146.3 pbw (0.45 mol) of bisphenol A-ethylene oxide (2 mol) adduct, 19.83 pbw (0.15 mol) of 2,2-diethyl-1,3-propanediol, 27.9 pbw (0.45 mol) of ethylene glycol, and 2.2 pbw (0.009 mol) of dibutyltin oxide as a catalyst. With the atmosphere in the reaction vessel replaced with dry nitrogen gas, the solution mixture therein was stirred for reaction at about 190° C. for about 6 hours under a nitrogen gas stream. With the temperature raised to about 240° C., stirring and reaction were continued for about 3 hours. After stirring and reaction, the reaction vessel was evacuated to 10.0 mmHg, and the solution mixture was stirred for reaction under reduced pressure for about 0.2 hours. Thus there was obtained a slightly yellowish transparent amorphous polyester resin (PESb), which has characteristic properties as shown in Table 1.

Example of Synthesis of Polyester Resin (PESc)

A reaction vessel equipped with a stirrer, thermometer, condenser, and nitrogen gas inlet tube was charged with 99.7 pbw (0.60 mol) of terephthalic acid, 66.5 pbw (0.39 mol) of isophthalic acid, 146.3 pbw (0.45 mol) of bisphenol A-ethylene oxide (2 mol) adduct, 237.7 pbw (0.69 mol) of bisphenol A-propylene oxide (2 mol) adduct, 19.83 pbw (0.15 mol) of 2,2-diethyl-1,3-propanediol, and 2.0 pbw (0.006 mol) of titanium (IV) tetrabutoxide monomer. With the atmosphere in the reaction vessel replaced with dry nitrogen gas, the solution mixture therein was stirred for reaction at about 180° C. for about 5 hours under a nitrogen gas stream. With the temperature raised to about 200° C., stirring and reaction were continued for about 1 hour. After stirring and reaction, the solution mixture was cooled to about 120° C. under a nitrogen gas stream. A sample of the solution mixture was tested by silica thin layer chromatography (TLC for short hereinafter) developed by ethyl acetate and n-hexane to confirm that the bisphenol A-ethylene oxide (2 mol) adduct did not remain unreacted. To the solution mixture were added 124.0 pbw (2.00 mol) of ethylene glycol and 1.0 pbw (0.003 mol) of titanium (IV) tetrabutoxide monomer. The solution mixture was stirred for reaction at about 180° C. for about 3 hours under a nitrogen gas stream. With the temperature raised to about 200° C., stirring and reaction were continued for about 1 hour. After stirring and reaction, the solution mixture was cooled to about 120° C. under a nitrogen gas stream. A sample of the solution mixture was tested by TLC developed by ethyl acetate and n-hexane to confirm that no acid components remained unreacted. The reaction vessel was evacuated to 0.8 mmHg, and the solution mixture was heated to 240° C. at a rate of 10° C./5 min, during which excess monomer was removed. Reaction was carried out for about 2.5 hours. Thus there was obtained a slightly yellowish transparent amorphous polyester resin (PESc), which has characteristic properties as shown in Table 1.

Example of Synthesis of Polyester Resin (PESd)

The same procedure as in Example 1 was repeated except that the reactants were replaced by the following and the reaction time and temperature were changed. 108. 0 pbw (0.65 mol) of terephthalic acid. 71.9 pbw (0.27 mol) of dodecenylsuccinic anhydride, 15.4 pbw (0.08 mol) of trimellitic acid, 97.5 pbw (0.30 mol) of bisphenol A-ethylene oxide (2 mol) adduct, 1.86 pbw (0.03 mol) of ethylene glycol, and 2.0 pbw (0.008 mol) of dibutyltin oxide as a catalyst. Thus there was obtained a slightly yellowish transparent amorphous polyester resin (PESd), which has characteristic properties as shown in Table 1.

Example of Synthesis of Polyester Resin (PESe)

Polyester resin (PESe) was obtained from 70 pbw of polyester resin PESb and 30 pbw of polyester resin (PESc) by melt mixing in a Banbury mixer. It has characteristic properties as shown in Table 1.

Example of Synthesis of Styrene-acrylate Copolymer Resin (STAf)

A reaction vessel, with its atmosphere therein replaced with dry nitrogen gas, was charged with 780 pbw of completely dehydrated THF (as a solvent), 277.7 pbw (2.67 mol) of styrene (as a monomer), 73.0 pbw (0.57 mol) of n-butyl acrylate, and 3.8 pbw (0.023 mol) of 2,2'-azobisisobutyronitrile. The resulting solution mixture was stirred for reaction at about 60° C. for about 60 hours. After reaction was completed, the solution mixture was slowly added dropwise with stirring to about 7000 pbw of methanol for precipitation. The precipitates thus obtained were filtered and vacuum-dried at about 40° C. Thus there was obtained styrene-acrylate copolymer resin (STAf), which has characteristic properties as shown in Table 1.

TABLE 1

| Resin | Mw (×1000) | Mn (×1000) | Tg | Temperature for tan δ (min) | tan δ (min) | Temperature at which G" is $10^4$ Pa |
|---|---|---|---|---|---|---|
| PESa | 9.5 | 4.6 | 67.1° C. | 76.5° C. | 1.49 | 97.5° C. |
| PESb | 8.5 | 3.5 | 50.5° C. | 60° C. | 1.65 | 75.2° C. |
| PESc | 30.0 | 15.0 | 60° C. | 75° C. | 0.60 | 135.5° C. |
| PESd | 37.5 | 5.5 | 65° C. | 78° C. | 1.25 | 115° C. |
| PESe | 18.0 | 5.2 | 54° C. | 64° C. | 1.00 | 100° C. |
| STAf | 18.5 | 9.0 | 50.7° C. | 63° C. | 1.35 | 80° C. |

tan δ (min) is the minimum value of tan δ in viscoelasticity of resin.
G" denotes the loss modulus of resin.

Example of Production of Aqueous Dispersion of Crosslinked Fine Particles (P1)

A reaction vessel equipped with a stirrer, reflux condenser, thermometer, and nitrogen inlet tube was charged with 920 pbw of deionized water. With the atmosphere therein thoroughly replaced with nitrogen, the reaction vessel was charged with 16 pbw of sodium dodecylbenzenesulfonate, 70 pbw of styrene monomer, 15 pbw of acrylic acid monomer, 20 pbw of divinylbenzene monomer, and 1.5 pbw of sodium persulfate. After thorough stirring, the solution mixture was subjected to reaction by stirring at about 250 rpm at 80° C. for about 5 hours. The reaction mixture was sucked off sequentially through filters each having a hole diameter of 8 μm, 2 μm, 1 μm, 0.8 μm, 0.6 μm, 0.45 μm, 0.2 μm, and 0.1 μm. so that coarse particles were removed. The filtrate was subjected to ultrafiltration (with about 50 liters of deionized water) through an ultrafiltration apparatus (from NGK Insulators, Ltd.) equipped with a ceramic filter. The content of solids was finally adjusted to 25 wt %. Thus there was obtained an aqueous dispersion of crosslinked fine particles (PI). These fine particles were found to be almost spherical and have an average particle diameter of about 0.067 μm. For measurements of particle diameter, a small portion of the aqueous dispersion was freeze-dried and dried particles were examined under a transmission electron microscope (TEN). The average particle diameter is an average value of 500 measurements of particles randomly selected from an electron micrograph.

Example of Production of Aqueous Dispersion of Crosslinked Fine Particles (P1 to P6)

The same procedure as for P1 was repeated except that the amount of sodium dodecylmbenzenesulfonate was changed and the filter to remove coarse particles was replaced. There were obtained five kinds of aqueous dispersion of crosslinked fine particles (P2 to P6). These fine particles were found to be almost spherical and have an average particle diameter as shown in Table 2.

TABLE 2

| Crosslinked fine particles | P1 | P2 | P3 | P4 | P5 | P6 |
|---|---|---|---|---|---|---|
| Average particle diameter | 67 nm | 81 nm | 150 nm | 266 nm | 340 nm | 630 nm |

Example of Production of Resin Dispersion of Fine Particles with Melt Flushing Treatment The aqueous dispersion of crosslinked particles (120 pbw) was mixed by melting with a binder resin (70 pbw) in a 3-liter pressure kneader. There was obtained a resin dispersion containing 30 wt % of fine particles. This step, which is referred to as melt flushing treatment, is explained below in more detail. First, the kneader was charged with 50 pbw of binder resin and 50 pbw of aqueous dispersion of crosslinked particles. With the rotor rotating at 30 rpm, the temperature was gradually raised to 105° C. and melt-mixing was carried out for about 45 minutes so as to remove water. With the temperature lowered to 90° C., the kneader was charged again with 10 pbw of binder resin and 40 pbw of aqueous dispersion of crosslinked particles. The temperature was gradually raised to 105° C. and melt-mixing was carried out for about 30 minutes. The remaining binder resin (10 pbw) and aqueous dispersion of crosslinked particles (40 pbw) underwent melt-mixing in the same way as above. Finally, the content in the kneader underwent melt-mixing at 120° C. for about 10 minutes. After cooling, the mixture was discharged from the kneader and roughly crushed into pieces several millimeters in size. The crushed pieces underwent melt-mixing in a Banbury mixer (at 120 rpm) for about 10 minutes. Thus there was obtained a resin dispersion of fine particles with melt flushing treatment. This resin dispersion was crushed into cubic pieces each having a side of about 0.5 cm. One of the fracture surfaces was observed under a scanning electron microscope (SEM) in the usual way. It was found that the resin dispersion contains particles extremely uniformly dispersed in the resin matrix, without aggregates. Incidentally, Tables 4 and 5 show the binder resin and the aqueous dispersion of crosslinked particles used in Examples and Comparative Examples. Tables 4 and 5 also show the composition of the resulting toner. In these tables, the melt flushing treatment is denoted by "MFB."

Example of Production of Resin Dispersion of Fine Particles with Melt-blending Treatment (1)

The aqueous dispersion of crosslinked particles was freeze-dried and then crushed by a mill to give dried particles. The dried particles together with a binder resin (in a ratio of 3:7 by weight) underwent melt-mixing ten times at 90–150° C. by a small twin-screw extruder made by Toyo Seiki Co., Ltd. The extrudate was finally crushed by a mill to give a resin dispersion of fine particles with melt-blending treatment (1). Tables 4 and 5 show the binder resin and the aqueous dispersion of crosslinked particles used in Examples and Comparative Examples. Tables 4 and 5 also show the composition of the resulting toner. In these tables, the melt blending treatment (1) is denoted by "EX1".

Example of Production of Resin Dispersion of Fine Particles With Melt-blending Treatment (2)

The aqueous dispersion of crosslinked particles was freeze-dried and then crushed by a mill to give dried particles. The dried particles together with a binder resin (in a ratio of 3:7 by weight) underwent melt-mixing once at 90–150° C. by a small twin-screw extruder made by Toyo Seiki Co., Ltd. The extrudate was finally crushed by a mill to give a resin dispersion of fine particles with melt-blending treatment (2). Tables 4 and 5 show the binder resin and the aqueous dispersion of crosslinked particles used in Examples and Comparative Examples. Tables 4 and 5 also show the composition of the resulting toner. In these tables, the melt blending treatment (2) is denoted by "EX2".

Inorganic Particles S1 to S4

Particles designated as S1 to S4 are those which are available from Nippon Aerosil Co., Ltd. and specified by the average particle diameter shown in Table 3.

TABLE 3

| Inorganic particles | S1 | S2 | S3 | S4 |
|---|---|---|---|---|
| Trade name | R976 | R805 | R972 | RX50 |
| Average particle diameter | 7 nm | 12 nm | 16 nm | 40 nm |

Example of Production of Resin Dispersion of Fine Particles With Resin Coating Treatment A resin solution was prepared from a binder resin (1000 g) dissolved in THF (2000 ml). This resin solution was incorporated with inorganic particles by stirring for 1 hour. THF was evaporated at 45° C. under reduced pressure. Thus there were obtained dry solids of inorganic particles coated with the binder resin. The dry solids were crushed by a mill. Thus there was obtained a resin dispersion of fine particles with resin coating treatment. Tables 4 and 5 show the binder resin and the inorganic fine particles used in Examples and Comparative Examples. Tables 4 and 5 also show the composition of the resulting toner. In these tables, the resin coating treatment is denoted by "PCS".

Examples 1 to 14

The following four components according to the composition shown in Table 4 underwent melt-mixing in a BANBURY mixer (Model BR made by Kobe Steel, Ltd.) at 120 rpm for about 15 minutes.

Binder resin

Resin dispersion of fine particles

Resin dispersion of cyan pigment ("CYANINE BLUE 4933M" from Dainichiseika Colour & Chemicals Mfg. Co., Ltd.) with flushing treatment (containing 30 wt % pigment)

Wax (optional)

The resulting mixture was rolled into a sheet (about 1 cm thick), and the sheet was crushed into coarse pieces (several millimeters in size) by a FITZMILL-type crusher. The coarse pieces were crushed into fine particles by an IDS-type crusher. The fine particles were classified sequentially by an elbow-type classifier. Thus there was obtained a cyan toner containing 10 wt % particles and 4 wt % pigment and having a volume mean diameter of d(50)=6.9 $\mu$m. The resulting cyan toner was incorporated with 3 wt % of hydrophobic silica powder ("R972" from Nippon Aerosil Co., Ltd.) by a HENSCHEL MIXER. In this way there were obtained cyan toners in Examples 1 to 14. Incidentally, the cyan toner was measured for particle size distribution with the COULTER COUNTER, Model TA-II made by Coulter Co., Ltd.

TABLE 4

| | Composition of toner | | | | | | | | |
|---|---|---|---|---|---|---|---|---|---|
| | Content of cyan pigment | Wax | | Binder resin | Resin dispersion of fine particles | | | Content of fine particles In toner | |
| | | kind | Content | | Dispersion treatment | Fine Particles/ Particle diameter | Binder resin | by volume | by weight |
| Example 1 | 4 wt % | none | — | PESa | MFB | P1/67 nm | PESa | 21.6% | 20% |
| Example 2 | 4 wt % | none | — | PESa | EX1 | P1/67 nm | PESa | 21.6% | 20% |
| Example 3 | 4 wt % | none | — | PESa | MFB | P4/266 nm | PESa | 26.8% | 25% |
| Example 4 | 4 wt % | none | — | PESa | PCS | S4/40 nm | PESa | 12.1% | 20% |
| Example 5 | 4 wt % | none | — | PESa | PCS | S1/7 nm | PESa | 6.4% | 11% |
| Example 6 | 4 wt % | none | — | PESa | PCS | S3/16 nm | PESa | 6.4% | 11% |
| Example 7 | 4 wt % | none | — | PESa | MFB | P2/81 nm | PESa | 21.6% | 20% |
| Example 8 | 4 wt % | Carnauba | 4 wt % | PESb | EX1 | P2/81 nm | PESb | 26.8% | 25% |
| Example 9 | 4 wt % | Carnauba | 4 wt % | PESb | MFB | P3/150 nm | PESb | 16.2% | 15% |
| Example 10 | 4 wt % | Carnauba | 4 wt % | PESb | MFB | P1/67 nm | PESb | 10.8% | 10% |
| | | | | | PCS | S3/16 nm | PESb | 5.8% | 10% |
| Example 11 | 4 wt % | Tetratetra-contan | 6 wt % | STAf | MFB | P1/67 nm | STAf | 21.6% | 20% |
| Example 12 | 4 wt % | Carnauba | 4 wt % | PESe | PCS | S1/7 nm | PESe | 8.9% | 15% |
| Example 13 | 4 wt % | Carnauba | 4 wt % | PESe | PCS | S2/12 nm | PESe | 12.0% | 20% |
| Example 14 | 4 wt % | Carnauba | 4 wt % | PESe | MFB | P2/81 nm | PESe | 5.5% | 5% |
| | | | | | PCS | S3/16 nm | PESe | 12.0% | 20% |

Cyan pigment "CYANINE BLUE 4933M" from Dainichiseika Colour & Chemicals Mfg. Co., Ltd.) with flushing treatment (containing 30 wt % pigment)
Carnauba: from Toa Kaseisha Co., Ltd. (melting point: 83° C.)
Tetratetracontan: from Lancaster (melting point: 86° C.)
MFB: melt flushing treatment; EX1: melt blending treatment (1); PCS: resin coating treatment.

Comparative Examples 1, 3, 7, 8, and 9

The same procedure as in Example 1 was repeated according to the composition shown in Table 5 except that the resin dispersion of fine particles was not used. Thus there were obtained cyan toners in Comparative Examples 1, 3, 7, 8, and 9.

Comparative Examples 2, 4, and 5

The same procedure as in Example 1 was repeated according to the composition shown in Table 5. Thus there were obtained cyan toners in Comparative Examples 2, 4, and 5.

Comparative Example 6

The same procedure as in Example 1 was repeated according to the composition shown in Table 5 except that fine particles (in the form aqueous dispersion P6 of crosslinked particles) were directly added, without fine particles being dispersed into a resin. Thus there was obtained a cyan toner in Comparative Example 6.

TABLE 5

| | Composition of toner | | | | | | | | |
|---|---|---|---|---|---|---|---|---|---|
| | Content of cyan pigment | Wax | | Binder resin | Resin dispersion of fine particles | | | Content of fine particles In toner | |
| | | kind | Content | | Dispersion treatment | Fine Particles/ Particle diameter | Binder resin | by volume | by weight |
| Comparative Example 1 | 4 wt % | none | — | PESa | — | — | — | — | — |
| Comparative Example 2 | 4 wt % | none | — | PESa | EX2 | P1/67 nm | PESa | 21.6% | 20% |
| Comparative Example 3 | 4 wt % | none | — | PESd | — | — | — | — | — |
| Comparative Example 4 | 4 wt % | none | — | PESa | EX2 | P5/340 nm | PESa | 21.6% | 20% |
| Comparative Example 5 | 4 wt % | none | — | PESa | EX2 | S4/40 nm | PESa | 12.1% | 20% |
| Comparative Example 6 | 4 wt % | none | — | PESa | none | P6/630 nm | PESa | 57.0% | 55% |
| Comparative Example 7 | 4 wt % | Carnauba | 4 wt % | PESb | — | — | — | — | — |
| Comparative Example 8 | 4 wt % | Carnauba | 4 wt % | PESe | — | — | — | — | — |
| Comparative Example 9 | 4 wt % | Carnauba | 4 wt % | PESb | — | — | — | — | — |

Cyan pigment: "CYANINE BLUE 4933M" from Dainichiseika Colour & Chemicals Mfg. Co., Ltd.) with flushing treatment (containing 30 wt % pigment)
Carnauba: from Toa Kaseisha Co., Ltd. (melting point: 83° C.)
EX: melt blending treatment (2)

Evaluation 1

The cyan toners obtained in Examples 1 to 14 and Comparative Examples 1 to 9 were tested to evaluate their viscoelastic properties and the state of dispersion of fine particles. The results are shown in Table 6 to 8.

State of Dispersion of Fine Particles

A sample of the toner was embedded in a two-component epoxy resin. The resulting block was cooled with liquefied nitrogen and then cut into ultrathin sections (about 80 μm thick) using a microtome equipped with a diamond knife. The sections were observed and photographed (at 30000× magnification) under a scanning electron microscope (FESEM). Photographs were taken for randomly selected 50 toner particles. Toner particles with aggregates having the maximum particle diameter of 1.0 μm or more were counted. The counted number was used to rate the state of dispersion of fine particle. The rating is indicated by ⊚ (good), ○ (fair), and X (poor). Incidentally, Tables 6 to 8 also show the number of toner particles containing aggregates having a particle diameter of 1.0 μm or more, out of 50 toner particles.

Viscoelastic Properties of Toner

The viscoelastic properties of the toner were measured in the following manner using a cone-and-plate rheometer having an apex angle of 0.1 rad and a diameter of 25 mm. ("RDA2" RHIOS system ver. 4.3 from Rheometric Co., Ltd.) About 0.5 g of toner sample was melted using a spatula on a hot plate which had been heated to the measuring temperature. The melt was formed into a round test piece about 25 mm in diameter. This procedure was completed within about 90–120 seconds. The rheometer was made stable at a temperature suitable for rheological measurement. The rheometer was set at a temperature which is 20° C. higher than the measuring temperature. One minute later, the test piece was placed at the center of the plate and pressed against the plate underneath using a spatula. The set temperature of the rheometer was switched to the measuring temperature. The upper cone was gradually and carefully lowered such that no air enters the gap between the test piece and the plate. The test piece was pressed until the plate gap reached 0.05 mm. That portion of the test piece which was squeezed out of the plate was wiped off, such that the side wall of the test piece was flushed with the side wall of the plate. The test piece was allowed to stand for 15 minutes so as to stabilize the temperature. The sequence of these steps should be completed within 40 minutes before the temperature stabilizes after the start of setting. After the temperature had stabilized, the following measurements (2) and (1) were continuously carried out in this order. Measurement (1): Dynamic complex modulus G* of toner (at 100% strain and 10 rad/sec frequency)

Measurement was carried out with the measuring frequency fixed at 10 rad/sec and the measuring temperature maintained. While the strain was changed from 1.0% to 100%, ten measurements were carried out (five measurements in the range from 1 to 9%) Thus the dependence on strain was obtained. Measurement (2): Frequency dependence G*(100 rad/sec)/G*(1 rad/sec) of dynamic complex modulus G* of toner (at 10% strain)

Measurement was carried out with the measuring strain fixed at 10%. While the frequency was changed from 0.1 to 400 rad/sec, 20 measurements were carried out (five measurements in the range from 1 to 9 rad/sec). Thus there was obtained the dependence on frequency, G*(100 rad/sec)/G*(1 rad/sec), which is indicated by G*(100)/G*(1) in the tables.

Measurements (1) and (2) were carried out at a temperature at which the binder resin of each toner exhibits a dynamic complex modulus G* of 1000 Pa (at 100% strain and 10 rad/sec frequency). The temperature was determined from measurement (1) carried out at different temperatures for the binder resin of each toner.

Tables 6 to 8 also show the tan δ (loss modulus G" divided by storage modulus G') due to the toner's viscoelasticity, which is measured at a temperature at which the binder resin exhibits a dynamic complex modulus G* of 1000 Pa (at 100% strain and 10 rad/sec frequency).

Evaluation 2

For the purpose of evaluation, each of the cyan toners obtained in Examples 1 to 11 and Comparative Examples 1 to 7 was tested for fixing characteristics, gloss, color development, heat offset properties, peeling characteristics (when supplied with a small amount of oil), toner heat storability, and image heat storability, by producing images. The test methods are explained below. The results are shown in Tables 6 and 7.

Image Output (1)

A developer was prepared by mixing from 8 pbw of toner and 100 pbw of carrier. This carrier was of resin-coated type, which was formed by coating ferrite cores with a mixture of amino group-containing vinyl polymer and fluoroalkyl group-containing vinyl polymer. The developer was placed in the developing unit of a color duplicator (A-color 935 made by Fuji Xerox Co., Ltd.), with the fixing unit removed. Unfixed images were produced using this developer. The image is a solid one, measuring 50 cm by 50 cm. The amount of toner is 0.65 mg per $cm^2$ of the image. The image was formed on "L Paper" (with a surface smoothness of 41 seconds) made by Fuji Xerox Office Supply Co., Ltd. "L Paper" has been commonly used for monochromatic duplicators.

Fixing Method (1)

Fixing was accomplished by using a color duplicator ("A-color 935" made by Fuji Xerox Co., Ltd.), with its fixing unit modified such that the roll temperature is variable. The fixing unit was set so that paper is transferred at a rate of 160 mm per second. The fixing unit was coated with silicone oil (fuser oil for A-color) so that offset would not occur. The application of silicone oil was accomplished by providing the heat roll with an oil-impregnated roll. The amount of oil was controlled by means of a blade. The coating weight of silicone oil was 2.0 mg per AA sheet (or $5.1\times10^{-3}$ mg/$cm^2$). The amount of silicone oil applied to paper was determined by passing a sheet of paper through the fixing unit, and extracting the oil-coated paper using a Soxhlet apparatus (which employs hexane as a solvent). The extract was analyzed by atomic absorption spectrometry. This fixing unit was used to fix the unfixed images. The temperature of the fixing unit was changed from 120° C. to 200° C. at an interval of 5° C.

Evaluation of Fixing Characteristics

The fixed images were visually examined to determine the temperature at which poor images due to incomplete toner melting disappear and the temperature at which poor images due to toner infiltration occur. These troubles are referred to as "density variation" and "infiltration variation" respectively hereinafter. An image with "density variation" literally varies in density from one part to another. "Density variation" appears at low fixing temperatures and disappears as the fixing temperature increases. On the other hand, "infiltration variation" manifests itself as shiny spots in an image. It occurs and worsens as the fixing temperature increases.

An image formed with the cyan toner in Comparative Example 1 was used as the reference image to determine the temperature at which the density variation disappears and the temperature at which the infiltration variation occurs. This reference image was compared with those images which were fixed with other toners, and the temperature at which the density variation disappears or the infiltration variation occurs was determined. The minimum temperature at which the density variation disappears is the minimum fixing temperature, and the temperature at which the infiltration variation occurs is the infiltration starting temperature. The latitude of infiltration is the range from the infiltration starting temperature to the minimum fixing temperature. In other words, it is a temperature range in which images without toner infiltration are obtained. The latitude of infiltration is rated as ○ (25° C. or higher), Δ (15° C. or higher but lower than 25° C.), and X (lower than 15° C.).

Evaluation of Gloss

The fixed image obtained at the minimum fixing temperature was examined for gloss using a gloss meter ("GM-26D" made by Murakami Shikisai Gijutsu Kenkyujo Co., Ltd.), with an incident angle of 75 degrees to the paper.

Evaluation of Color Development

Color development is rated as ○ if the gloss value is 15 or higher (in which case there is no problem with color development) and as X if the gloss value is lower than 15 (in which case the image remarkably lacks density).

Evaluation of Heat Offset

The heat offset temperature is the temperature at which a visible soil appears in the image as the fixing temperature is gradually increased. Such soiling occurs at a position on the transfer body corresponding to the second turn of the fixing unit, because the toner image moves to the surface of the fixing unit due to cohesive failure as the fixing temperature increases.

Evaluation of Peelability in Fixing Supplied with a Small Amount of Oil

Solid images were formed according to the method explained in "Image output (1)" and "Fixing method (1)" above. Each image measures 50 mm by 270 mm, and the amount of toner is 2.0 mg per $cm^2$. The solid image at the end of paper was fixed at temperatures differing in increments of 5° C. The ability of toner-carrying paper to peel from the fixing roll was evaluated. The peelability is rated as ○ or X depending on whether the temperature at which paper peels from the fixing roll without winding on it is 30° C. or higher or in the range from 0° C. or higher but lower than 30° C.

Evaluation of Heat Storability (Heat Blocking Resistance) of Toner

A toner sample (5 g) was allowed to stand in a chamber at 40° C. and 50% RH for 17 hours. After cooling to room temperature, the toner (2 g) was sieved through a 45 μm mesh by vibration under prescribed conditions. The amount of the toner which remained on the mesh was weighed. The ratio of the amount which remained on the mesh to the amount which was placed on the mesh was calculated. The resulting value was regarded as the index of heat blocking resistance of toner. The toner is rated as ⊙ (an index of 3% or lower), ○ (an index exceeding 3% and up to 5%), Δ (an index exceeding 5% and up to 10%), and X (an index exceeding 10%).

Evaluation of Heat Storability of Images (Document Offset of Fixed Images)

Fixed images were placed one over another under a load of 50 g/m$^2$, and they were allowed to stand in a chamber at 55° C. and 60% RH for 7 days. Images were examined for offset. Images were rated as ⊙ (images peel freely or remain intact even though peeled by force), ○ (images remain intact (without image transfer) when peeled), Δ (images are damaged (with image transfer) when peeled, but paper is not torn off), and X (images are damaged and paper is torn off when peeled).

TABLE 6

| | Physical properties of toner | | | | | Performance of toner | | | | | | | | | |
|---|---|---|---|---|---|---|---|---|---|---|---|---|---|---|---|
| | | | | | | Latitude of Infiltration | | | | | | | | | |
| | Dispersion of fine particles | | Viscoelasticity of toner | | | Minimum fixing temperature | Gloss value | Infiltration starting temperature | Latitude | | Color development | Hot offset temperature | Peelability | Heat storability of toner | Heat storability of image |
| | Number | Rating | G" (Pa) | G" (100)/G" (1) | tan δ | | | | | Rating | | | | | |
| Example 1 | 10/50 | ⊙ | 9500 | 2.5 | 3.1 | 140° C. | 33 | 195° C. | 55° C. | ○ | ○ | 200° C. | ○ | ⊙ | ⊙ |
| Example 2 | 20/50 | ○ | 6500 | 4.1 | 4.5 | 140° C. | 32 | 185° C. | 45° C. | ○ | ○ | 195° C. | ○ | ⊙ | ⊙ |
| Example 3 | 9/50 | ⊙ | 6100 | 4.0 | 4.5 | 145° C. | 23 | 190° C. | 45° C. | ○ | ○ | 200° C. | ○ | ⊙ | ⊙ |
| Example 4 | 3/50 | ⊙ | 5000 | 6.6 | 6.6 | 140° C. | 33 | 175° C. | 35° C. | ○ | ○ | 195° C. | ○ | ⊙ | ○ |
| Example 5 | 4/50 | ⊙ | 3800 | 9.8 | 2.9 | 140° C. | 35 | 170° C. | 30° C. | ○ | ○ | 190° C. | ○ | ⊙ | ○ |
| Example 6 | 2/50 | ⊙ | 2800 | 18.0 | 5.1 | 140° C. | 36 | 165° C. | 25° C. | ○ | ○ | 185° C. | ○ | ○ | ○ |
| Example 7 | 8/50 | ⊙ | 9300 | 2.6 | 3.4 | 140° C. | 31 | 195° C. | 55° C. | ○ | ○ | 205° C. | ○ | ⊙ | ⊙ |
| Example 8 | 16/50 | ○ | 9000 | 3.0 | 3.5 | 125° C. | 22 | 170° C. | 45° C. | ○ | ○ | 180° C. | ○ | ⊙ | ○ |
| Example 9 | 6/50 | ⊙ | 7500 | 5.0 | 4.0 | 120° C. | 33 | 165° C. | 45° C. | ○ | ○ | 180° C. | ○ | ⊙ | ○ |
| Example 10 | 8/50 | ⊙ | 7000 | 3.9 | 3.8 | 120° C. | 30 | 165° C. | 45° C. | ○ | ○ | 180° C. | ○ | ⊙ | ○ |
| Example 11 | 7/50 | ⊙ | 8500 | 2.7 | 4.0 | 125° C. | 35 | 170° C. | 45° C. | ○ | ○ | 175° C. | ○ | ○ | ○ |

TABLE 7

| | Physical properties of toner | | | | | Performance of toner | | | | | | | | | |
|---|---|---|---|---|---|---|---|---|---|---|---|---|---|---|---|
| | | | | | | Latitude of Infiltration | | | | | | | | | |
| | Dispersion of fine particles | | Viscoelasticity of toner | | | Minimum fixing temperature | Gloss value | Infiltration starting temperature | Latitude | | Color development | Hot offset temperature | Peelability | Heat storability of toner | Heat storability of image |
| | Number | Rating | G" (Pa) | G" (100)/G" (1) | tan δ | | | | | Rating | | | | | |
| Comparative Example 1 | — | — | 1000 | 350.0 | 9.0 | 140° C. | 36 | 155° C. | 15° C. | X | ○ | 185° C. | ○ | ○ | ○ |
| Comparative Example 2 | 30/50 | X | 2500 | 8.0 | 6.5 | 150° C. | 27 | 165° C. | 15° C. | X | ○ | 185° C. | ○ | ○ | ○ |
| Comparative Example 3 | — | — | 1000 | 150.0 | 2.0 | 155° C. | 30 | 170° C. | 20° C. | Δ | ○ | 185° C. | ○ | ○ | ○ |
| Comparative Example 4 | 35/50 | X | 2800 | 11.0 | 8.0 | 150° C. | 30 | 165° C. | 15° C. | X | ○ | 190° C. | ○ | ○ | ○ |
| Comparative Example 5 | 33/50 | X | 2800 | 7.5 | 7.5 | 145° C. | 34 | 160° C. | 15° C. | X | ○ | 190° C. | ○ | ○ | ○ |
| Comparative Example 6 | 38/20 | X | 90000 | 1.5 | 1.0 | 200° C. | 5 | — | — | — | X | — | — | — | — |

TABLE 7-continued

| | Physical properties of toner | | | | | Performance of toner | | | | | | | | | |
|---|---|---|---|---|---|---|---|---|---|---|---|---|---|---|---|
| | | | | | | Latitude of Infiltration | | | | | | | | | |
| | Dispersion of fine particles | | Viscoelasticity of toner | | | Minimum fixing temperature | Gloss value | Infiltration starting temperature | Latitude | | Color development | Hot offset temperature | Peelability | Heat storability of toner | Heat storability of image |
| | Number | Rating | G" (Pa) | G" (100)/G" (1) | tan δ | | | | | Rating | | | | | |
| Comparative Example 7 | — | — | 1000 | 300.0 | 10.0 | 120° C. | 37 | 135° C. | 15° C. | X | ○ | 165° C. | ○ | X | X |

Evaluation 3

For the purpose of evaluation, each of the cyan toners obtained in Examples 12 to 14 and Comparative Examples 8 and 9 was tested for fixing characteristics, gloss, color development, heat offset properties, toner heat storability, and image heat storability, by producing images. The test methods are explained below. The results are shown in Table 8.

Image Output (2)

Unfixed images were obtained in the same way as for "image output (1)" above.

Fixing Method (2)

Fixed images were obtained in the same way as for "fixing method (1)" above except that the surface material of the fixing roll was replaced by TEFLON tube and no silicone oil was applied.

Evaluation of Peelability of Fixed Images Formed without Oil

Solid images were formed according to the method explained in "Image output (2)" and "Fixing method (2)" above. Each image measures 50 mm by 270 mm, and the amount of toner is 2.0 mg per $cm^2$. The solid image at the end of paper was fixed at temperatures differing in increments of 5° C. The ability of toner-carrying paper to peel from the fixing roll was evaluated. The peelability is rated as ○ or X depending on whether the temperature at which paper peels from the fixing roll without winding on it is 30° C. or higher or in the range 0° C. or higher but lower than 30° C.

TABLE 8

| | Physical properties of toner | | | | | Performance of toner | | | | | | | | | |
|---|---|---|---|---|---|---|---|---|---|---|---|---|---|---|---|
| | | | | | | Latitude of Infiltration | | | | | | | | | |
| | Dispersion of fine particles | | Viscoelasticity of toner | | | Minimum fixing temperature | Gloss value | Infiltration starting temperature | Latitude | | Color development | Hot offset temperature | Peelability | Heat storability of toner | Heat storability of image |
| | Number | Rating | G" (Pa) | G" (100)/G" (1) | tan δ | | | | | Rating | | | | | |
| Example 12 | 3/50 | ◎ | 5000 | 5.0 | 2.0 | 140° C. | 29 | 170° C. | 30° C. | ○ | ○ | 200° C. | ○ | ○ | ○ |
| Example 13 | 2/50 | ◎ | 18000 | 5.8 | 1.8 | 145° C. | 27 | 185° C. | 40° C. | ○ | ○ | 210° C. | ○ | ○ | ○ |
| Example 14 | 5/50 | ◎ | 11000 | 3.2 | 1.7 | 140° C. | 25 | 185° C. | 45° C. | ○ | ○ | 210° C. | ○ | ◎ | ○ |
| Comparative Example 8 | — | — | 1000 | 100.0 | 7.0 | 180° C. | 38 | 175° C. | 15° C. | X | ○ | 195° C. | ○ | X | Δ |
| Comparative Example 9 | — | — | 1000 | 300.0 | 10.0 | 120° C. | 37 | 135° C. | 15° C. | X | ○ | 145° C. | X | X | X |

Evaluation 4

Fixed images were obtained using each of the cyan toners obtained in Examples 1 to 14 and Comparative Examples 1 to 9. They were tested for OHP light transmission. The methods for image output and fixing and evaluation are explained below.

Image Output (3)

Unfixed images were obtained in the same way as for "image output (1)" above except that "L paper" was replaced by monochromatic OHP made by Fuji Xerox Co., Ltd. In addition to solid images, images of 50% density were also produced.

Fixing Method (3)

In the case of cyan toners in Examples 1 to 11 and Comparative Examples 1 to 7, fixed images were obtained in the same way as for "fixing method (1)" above except that the transfer rate was changed to 30 mm/sec and the fixing unit was set at a temperature which is 15° C. higher than the minimum fixing temperature for each toner.

In the case of cyan toners in Examples 12 to 14 and Comparative Examples 8 and 9, fixed images were obtained in the same way as for "fixing method (2)" above except that the transfer rate was changed to 30 mm/sec and the fixing unit was set at a temperature which is 15° C. higher than the minimum fixing temperature for each toner.

OHP Light Transmission

The light transmission of the fixed images was measured using a spectrophotometer (U-3210 made by Hitachi, Ltd.) at a wavelength of 480 nm.

Results of Evaluations 1 to 4

Regarding Examples 1 to 11 and Comparative Examples 1 to 7

The cyan toner in Comparative Example 1 is the same one as used for conventional color duplicators. It melts so sharply that it infiltrates into paper as the temperature is raised by 15° C. from the temperature at which uneven melting disappears. The temperature range of 15° C. is permissible for "L paper" made by Fuji Xerox Office Supply Co., Ltd. However, this temperature range would be narrower as the paper density becomes lower and the paper surface becomes rougher. The permissible range would be narrower or even zero in the case of "S paper" made by Fuji Xerox Office Supply Co., Ltd. and "WR paper" and "Green 100 paper" which are recycled paper with rough surface, made by Fuji Xerox Office Supply Co., Ltd.

In contrast, all the cyan toners in Examples 1 to 11, which meet the requirements for dispersibility of fine particles, have a permissible temperature range of 25° C. or higher. Particularly, those in Examples 1 to 5 and 7 to 11 have a permissible temperature range of 30° C. or higher. Therefore, they can be applied to low-quality paper mentioned above. Moreover, they give good images (with gloss of 30 or more) and permit good color development.

It is noted from the results in Examples 1 and 2 that the cyan toner in Example 2, which contains fine particles without flushing treatment or complete resin coating, meets the requirement for viscoelasticity but has a limited temperature range because of slightly poor particle dispersion. The cyan toner in Example 6 meets the requirements for dispersion (specified in the present invention) but has a comparatively limited temperature range because of slightly poor viscoelastic properties. Conversely, the cyan toners in Comparative Examples 1, 3, and 7 do not contain fine particles and hence have no permissible temperature range. As compared with the cyan toner in Comparative Example 1, the one in Comparative Example 3 employs a binder resin having a higher molecular weight but has no permissible temperature range and increases in the minimum fixing temperature. The cyan toners in Comparative Examples 2, 4, 5, and 6 do not meet the requirements for fine particles dispersion and viscoelasticity (specified in the present invention) and hence do not have a sufficient permissible temperature range. The cyan toner in Comparative Example 6 has an excessively high viscoelasticity and hence increases in fixing temperature and is poor in color development and OHP light transmission (35%).

The cyan toners in Examples 1 to 11 are superior in latitude for infiltration, color development, hot offset performance, peelability, heat storability of toner and heat storability of images, and hence they exhibit satisfactory performance for practical use. The cyan toners in Examples 1 to 11 have an OHP light transmission of 80% or more, which is satisfactory for practical use. They also give a light transmission of 75% or more at an image density of 50%. They give OHP transmitting images with a bright color.

As compared with the cyan toners in Examples 1 to 7, those in Examples 8 to 11 are capable of fixing at a lower temperature and superior in heat storability of toner and heat storability of images even though they employ a binder resin having a lower softening temperature. In contrast, the cyan toner in Comparative Example 7, which employs a binder resin having a low softening temperature, is capable of fixing at a low temperature but is poor in heat storability of toner and heat storability of images and is of no practical use.

Regarding Examples 12 to 14 and Comparative Examples 8 and 9

The cyan toners in Examples 12 to 14 exhibit good peelability when fixed without oil as specified in "fixing method (2)" and are good in latitude of infiltration, color development, hot offset performance, heat storability of toner, and heat storability of images. The cyan toners in Examples 12 to 14 have an OHP light transmission of 80% or more, which is satisfactory for practical use. They also give a light transmission of 75% or more at an image density of 50%. They also give OHP transmitting images with a bright color. The cyan toner in Example 14 is particularly superior in heat storability of toner because it employs two kinds of fine particles.

The cyan toner in Comparative Example 8 is good in peelability but is high in the minimum fixing temperature although it employs the same binder resin as used in the cyan toners in Examples 12 to 14 and is poor in heat storability of toner and heat storability of images and is of no practical use. The cyan toner in Comparative Example 9 contains a binder resin whose viscoelasticity is not suitable for oilless fixing and hence gives monochromatic images that can be peeled (if the toner thickness if 0.45 mg/cm$^2$) but does not give full color images that can be peeled (if the toner thickness is 1.4 mg/cm$^2$).

Evaluation 5

The same procedure as in Example 1 was repeated to produce a magenta toner, a yellow toner, and a black toner in place of the cyan toner except that the cyan pigment was replaced by a magenta pigment ("SEIKAFAST Carmine 1476T-7", from Dainichiseika Colour & Chemicals Mfg. Co., Ltd.), a yellow pigment ("SEIKAFAST Yellow 2400", from Dainichiseika Colour & Chemicals Mfg. Co., Ltd.), and carbon black ("CARBON BLACK #25", from Mitsubishi Chemical Corporation), respectively. These toners in combination with the cyan toner in Example 1 were used as a full-color toner (consisting of four colors). Using this full-color toner, fixed images were produced according to the methods explained in "Image output (4)" and "Fixing method (4)" below. The full-color toner was tested for durability in the following way. The cyan toners in Examples 7 and 13 were also tested in the same way.

Image Output (4)

Developing agents were prepared from each of the four toners (for full-color toner) and a carrier. Unfixed images were produced in the same way as in "Image output (1)" above. Incidentally, the carrier is the same one as used in "Image output (1)" above.

Fixing Method (4)

Fixed images were produced in the same way as in "Fixing method (1)" above.

Durability Test

Ten thousand images were produced and fixed continuously. The fixed images were visually examined for any troubles.

Results of Durability Test

After continuous image production (10,000 copies), no disturbance occurred in images and the image quality was as good as that of initial images. No troubles occurred in each electrophotographic process of development, transfer, and fixing.

Evaluation 6

Using the cyan toner in Example 4, fixed images were produced according to the methods explained in "Image output (5)" and "Fixing method (5)" below, and they were evaluated in the following manner.

Image Output (5)

Unfixed images were obtained in the same way as in "Image output (1)" above.

Fixing Method (5)

Fixed images were produced by using a belt fixing unit of thermal transfer system.

Evaluation of Fixed Images

The resulting fixed images were visually inspected.

Results of Evaluation of Fixed Images

The resulting fixed images were of high quality without image distortion.

The present invention provides color toners for electrophotography which are characterized by complete dispersion of fine particles in the toner, viscoelasticity in a specific range, freedom from uneven melting, and freedom from toner infiltration into paper fiber. After fixing, the color toners yield images of high quality with bright color and also yield OHP images with high light transmission. They are superior in beat blocking resistance and yet capable of fixing at low temperatures. They exhibit good peelability even when oil is not used. They can be produced efficiently.

As described above, according to this invention, an electrophotographic color toner which has a broad fixable temperature region of the toner and does not cause an image deterioration by preventing the occurrence of the penetration phenomenon into a paper while keeping a high image quality and high coloring even by using paper other than a paper for color copy without deteriorating various characteristics of a toner of prior art, and also an electrophotographic developer using the toner and an image-forming process using the developer can be provided.

What is claimed is:

1. An electrophotographic color toner containing at least a coloring agent and a binder resin, wherein the dynamic complex elastic modulus G* (distortion ratio 100%, frequency 10 rad/sec.) of the toner measured at a temperature at which the dynamic complex elastic modulus $G^{*1}$ (distortion ratio 100%, frequency 10 rad/sec.) of said binder resin becomes 1000 Pa is from 3000 to 50,000 Pa; wherein the color toner further comprises light-color or colorless fine particles that are organic or inorganic and have an average primary particle size of 1 to 500 nm, wherein the organic fine particles have substantially no crosslinked structure and have a glass transition temperature of at least 130° C., and wherein the fine particles are dispersed uniformly in the toner particles.

2. An electrophotographic color toner according to claim 1, wherein toner particles containing light-color or colorless fine particles having a particle size of at least 1.0 $\mu$m do not constitute more than half of the total number toner particles.

3. An electrophotographic color toner according to claim 2, wherein the toner particles containing light-color or colorless fine particles having a particle size of at least 1.0 $\mu$m do not constitute more than ⅔ of the total number of toner particles.

4. An electrophotographic color toner according to claim 1 wherein the frequency dependency of the dynamic complex elastic modulus G*(distortion ratio 10%) of the toner measured at a temperature at which the dynamic complex elastic modulus $G^{*1}$ (distortion ratio 100%, frequency 10 rad/sec.) of the binder resin becomes 1000 Pa is shown by following formula (2):

$$G^*(100\ \text{rad/sec.})/G^*(1\ \text{rad/sec.})<10 \qquad (2).$$

5. An electrophotographic color toner according to claim 1 wherein tan δ (lose elastic modulus G"/storage elastic modulus G') in the viscoelasticity of the toner measured at a temperature at which the dynamic complex elastic modulus $G^{*1}$ (distortion ratio 100%, frequency 10 rad/sec.) of the binder resin becomes 1000 Pa is at least 1.1.

6. An electrophotographic developer containing at least a toner, wherein said toner is the electrophotographic color toner described in claim 1.

7. An image-forming process including a step of forming an electrostatic latent image on a latent image support, a step of developing the latent image using an electrophotographic developer to form a toner image, a step of transferring the developed toner image onto a transfer material, and a step of fixing the toner image on the transfer material, wherein said electrophotographic developer is the electrophotographic developer described in claim 6.

8. An image-forming process according to claim 7 wherein the surface smoothness of the transfer material is 80 seconds or lower.

9. An image-forming process according to claim 7 wherein the step of fixing is carried out using a heat-contact fixing apparatus.

* * * * *